US011541290B2

(12) United States Patent
Jertson et al.

(10) Patent No.: US 11,541,290 B2
(45) Date of Patent: Jan. 3, 2023

(54) MULTI-COMPONENT GOLF CLUB HEAD

(71) Applicant: Karsten Manufacturing Corporation, Phoenix, AZ (US)

(72) Inventors: Martin R. Jertson, Phoenix, AZ (US); Erik M. Henrikson, Phoenix, AZ (US); Samuel J. Pendred, Denford (GB); Jeremy S. Pope, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/301,006

(22) Filed: Mar. 22, 2021

(65) Prior Publication Data

US 2021/0205678 A1 Jul. 8, 2021

Related U.S. Application Data

(63) Continuation of application No. 16/789,261, filed on Feb. 12, 2020, now Pat. No. 10,953,294, which is a continuation of application No. 16/215,474, filed on Dec. 10, 2018, now Pat. No. 10,596,427.

(60) Provisional application No. 62/596,677.

(51) Int. Cl.

| | |
|---|---|
| ***A63B 53/08*** | (2015.01) |
| ***A63B 53/06*** | (2015.01) |
| ***A63B 53/04*** | (2015.01) |
| ***A63B 102/32*** | (2015.01) |

(Continued)

(52) U.S. Cl.

CPC ..... *A63B 53/08* (2013.01); *A63B 1/00* (2013.01); *A63B 53/06* (2013.01); *A63B 53/045* (2020.08); *A63B 53/0412* (2020.08); *A63B 53/0433* (2020.08); *A63B 53/0466* (2013.01); *A63B 60/54* (2015.10); *A63B 2053/0491* (2013.01);

(Continued)

(58) Field of Classification Search

CPC . A63B 53/08; A63B 53/06; A63B 2053/0491; A63B 60/54; A63B 53/0466; A63B 2209/023; A63B 2102/32; A63B 53/045; A63B 53/0433; A63B 2209/00

USPC ..... 473/324–350, 287–292

See application file for complete search history.

(56) References Cited

U.S. PATENT DOCUMENTS

| | | | |
|---|---|---|---|
| 6,471,604 | B2 | 10/2002 | Hocknell |
| 6,575,845 | B2 | 6/2003 | Galloway |
| 6,663,504 | B2 | 12/2003 | Hocknell et al. |
| 6,739,983 | B2 | 5/2004 | Helmstetter |

(Continued)

FOREIGN PATENT DOCUMENTS

| | | | |
|---|---|---|---|
| CN | 1654100 | A | 8/2005 |
| JP | 2004024734 | A | 1/2004 |

(Continued)

OTHER PUBLICATIONS

Jason Bruno, TaylorMade ('17) M1 Driver Review, accessed Sep. 14, 2017.

(Continued)

*Primary Examiner* — Sebastiano Passaniti

(57) ABSTRACT

A golf club head comprising two components, wherein the first component comprise a ball striking surface, a striking face return, and a sole extension with a rear mass. And wherein the second component comprises a lower density material, comprising part of the crown and part of the sole. The first component comprises a majority of the mass of the (Continued)

golf club head, having a rear mass comprising 20% to 35% of the mass of the golf club head.

16 Claims, 21 Drawing Sheets

(51) Int. Cl.
*A63B 1/00* (2006.01)
*A63B 60/54* (2015.01)

(52) U.S. Cl.
CPC ..... *A63B 2102/32* (2015.10); *A63B 2209/00* (2013.01); *A63B 2209/023* (2013.01)

(56) References Cited

U.S. PATENT DOCUMENTS

| | | | | |
|---|---|---|---|---|
| 6,872,152 | B2 | 3/2005 | Beach | |
| 6,929,565 | B2 | 8/2005 | Nakahara et al. | |
| 7,025,692 | B2 | 4/2006 | Erickson et al. | |
| 7,258,625 | B2 | 8/2007 | Kawaguchi | |
| 7,285,060 | B2 | 10/2007 | Williams | |
| 7,338,390 | B2 | 3/2008 | Lindsay | |
| 7,455,600 | B2 | 11/2008 | Imamoto | |
| 7,530,903 | B2 | 5/2009 | Imamoto et al. | |
| 7,601,078 | B2 | 10/2009 | Mergy et al. | |
| 7,785,212 | B2 | 8/2010 | Lukasiewicz et al. | |
| 7,806,782 | B2 | 10/2010 | Stites | |
| 7,938,741 | B2 * | 5/2011 | Evans | A63B 60/00 473/335 |
| 7,959,522 | B2 | 6/2011 | North | |
| 8,025,591 | B2 | 9/2011 | Cruz et al. | |
| 8,506,421 | B2 | 8/2013 | Stites et al. | |
| 8,585,514 | B2 | 11/2013 | Boyd et al. | |
| 8,870,683 | B2 | 10/2014 | Hettinger et al. | |
| 8,926,450 | B2 | 1/2015 | Takahashi et al. | |
| 8,979,671 | B1 * | 3/2015 | DeMille | A63B 60/00 473/335 |
| 9,079,368 | B2 | 7/2015 | Tavares et al. | |
| 9,168,435 | B1 | 10/2015 | Boggs et al. | |
| 9,220,955 | B2 | 12/2015 | Hayase et al. | |
| 9,352,198 | B2 | 5/2016 | Roach et al. | |
| 9,452,325 | B2 | 9/2016 | DeShiell et al. | |
| 9,457,245 | B2 | 10/2016 | Lee | |
| 9,833,666 | B2 * | 12/2017 | Boggs | A63B 53/0466 |
| 9,873,029 | B1 * | 1/2018 | Sillies | A63B 60/02 |
| 10,004,954 | B2 * | 6/2018 | Chen | A63B 53/0466 |
| 10,046,212 | B2 | 8/2018 | Sargent et al. | |
| 10,556,159 | B2 * | 2/2020 | Stokke | A63B 53/0466 |
| 10,596,427 | B2 | 3/2020 | Jertson | |
| 10,765,922 | B2 * | 9/2020 | Morales | A63B 60/02 |
| 10,864,416 | B2 * | 12/2020 | Jertson | A63B 53/0466 |
| 10,953,294 | B2 * | 3/2021 | Jertson | A63B 53/06 |
| 11,040,256 | B2 * | 6/2021 | Milleman | A63B 53/0466 |
| 2004/0005936 | A1 | 1/2004 | Imamoto | |
| 2004/0116207 | A1 | 6/2004 | Shiell et al. | |
| 2005/0159243 | A1 | 7/2005 | Chuang | |
| 2005/0239576 | A1 | 10/2005 | Stites | |
| 2006/0084525 | A1 | 4/2006 | Imamoto | |
| 2007/0155533 | A1 | 7/2007 | Solheim et al. | |
| 2008/0139339 | A1 | 6/2008 | Cheng | |
| 2008/0293512 | A1 | 11/2008 | Chen | |
| 2010/0139079 | A1 | 6/2010 | Dawson et al. | |
| 2016/0339307 | A1 * | 11/2016 | Stokke | A63B 60/00 |
| 2019/0176001 | A1 | 6/2019 | Jertson | |

FOREIGN PATENT DOCUMENTS

| | | | |
|---|---|---|---|
| JP | 3103394 | U | 8/2004 |
| JP | 2005230332 | A | 9/2005 |
| JP | 2011072661 | A | 4/2011 |
| JP | 2014008141 | A | 1/2014 |

OTHER PUBLICATIONS

Russley Golf Club; A new level of distance and forgiveness, The new TaylorMade M2 Driver, accessed Sep. 14, 2017.

New E9 Face Technology With Dual Roll Gives You Even Longer and More Forgiving Drives, Fairway Golf USA, accessed Jun. 7, 2016.

Women's Great Big Bertha Driver, Callaway Certified Pre-Owned, accessed Mar. 18, 2019.

* cited by examiner

MULTI-COMPONENT GOLF CLUB HEAD

CROSS REFERENCE TO RELATED APPLICATIONS

This is a continuation of U.S. patent application Ser. No. 16/215,474 filed Dec. 10, 2018, which claims the benefit of U.S. Provisional Application No. 62/596,677 filed Dec. 8, 2017, the contents of which are fully incorporated herein by reference.

FIELD

The disclosure relates generally to golf equipment, and more particularly, to multi-component golf club heads and methods to manufacture multi-component golf club heads.

BACKGROUND

In general, the club head mass is the total amount of structural mass and the amount of discretionary mass. In an ideal club design, having a constant total swing weight, structural mass would be minimized (without sacrificing resiliency) to provide a designer with sufficient discretionary mass for optional placement to customize and maximize club performance. Structural mass generally refers to the mass of the materials required to provide the club head with the structural resilience to withstand repeated impacts. Structural mass is highly design-dependent, and provides a designer with a relatively low amount of control over specific mass distribution. Conversely, discretionary mass is any additional mass (beyond the minimum structural requirements) that may be added to the club head design solely to customize the performance and/or forgiveness of the club. There is a need in the art for alternative designs to all metal golf club heads to provide a means for maximizing discretionary weight to maximize club head moment of inertia (MOI) and lower/back center of gravity (CG), and provide options for golf ball flight manipulation.

DETAILED DESCRIPTION

Figure 1A:
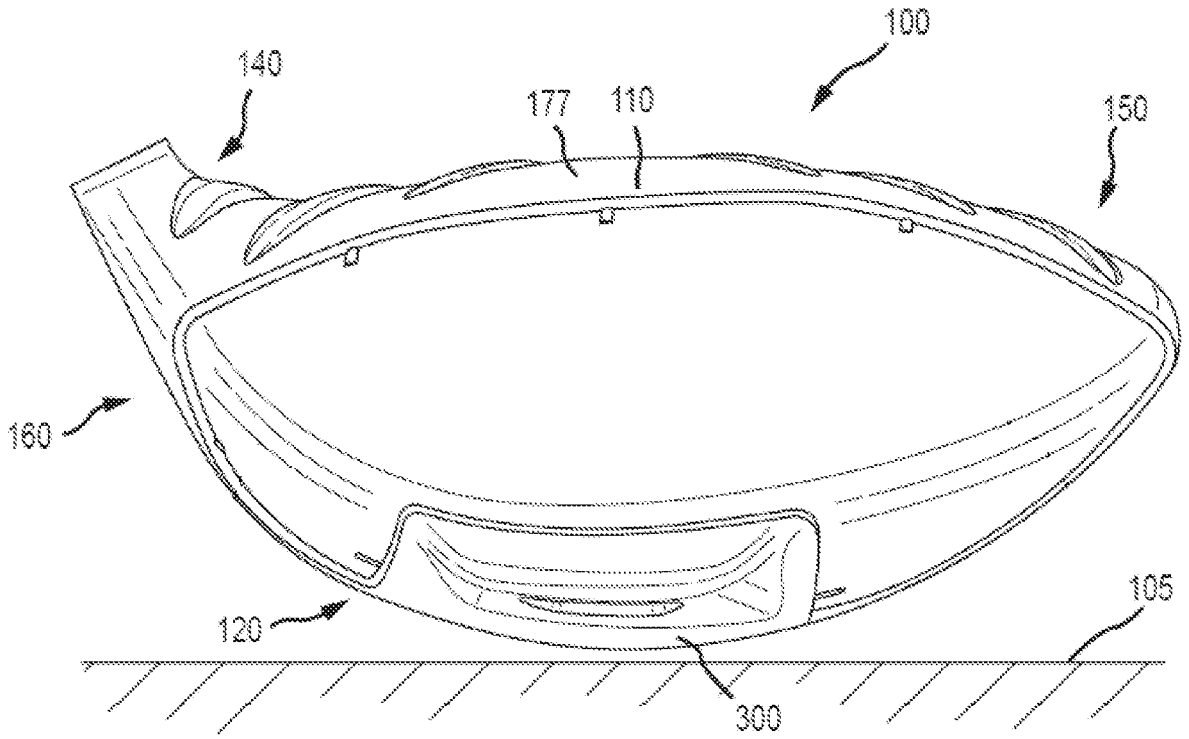
FIG. 1A illustrates a back view of an assembled golf club head.
Figure 1B:
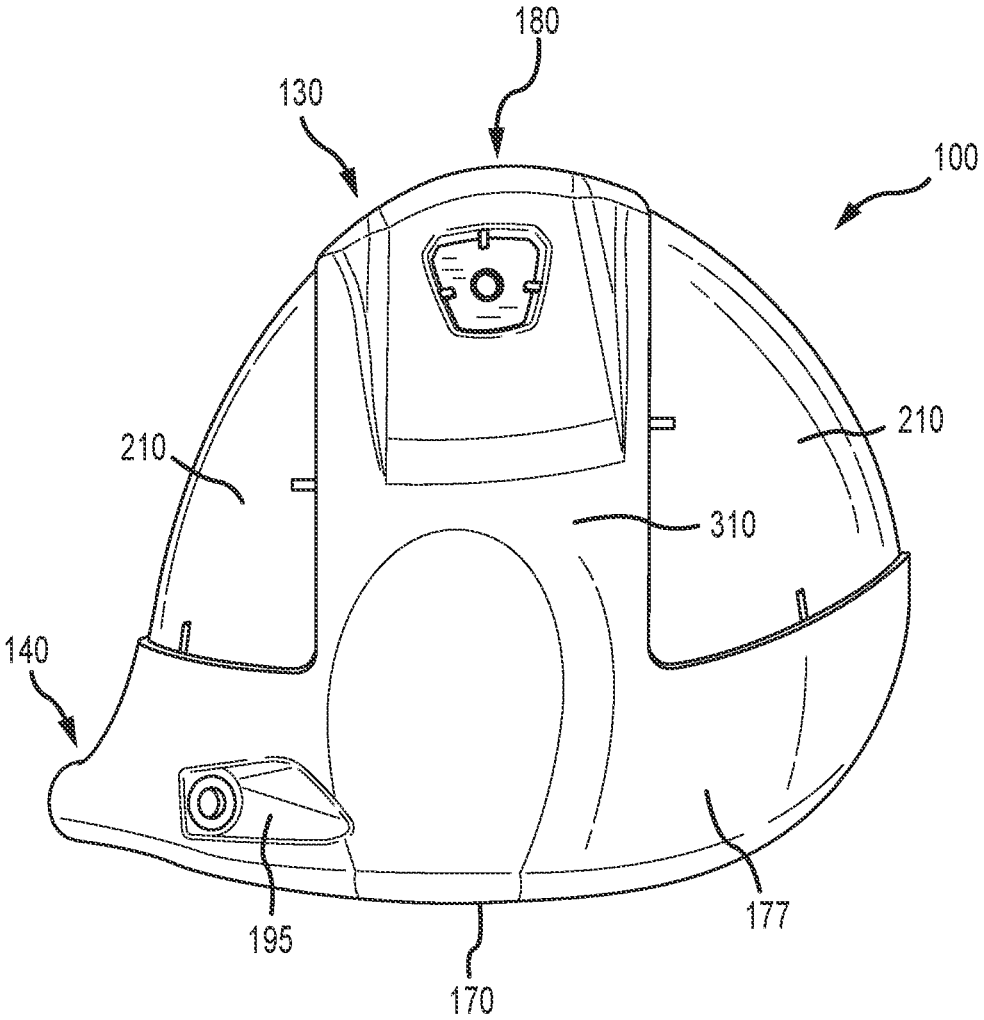
FIG. 1B illustrates a bottom view of an assembled golf club head.
Figure 1C:
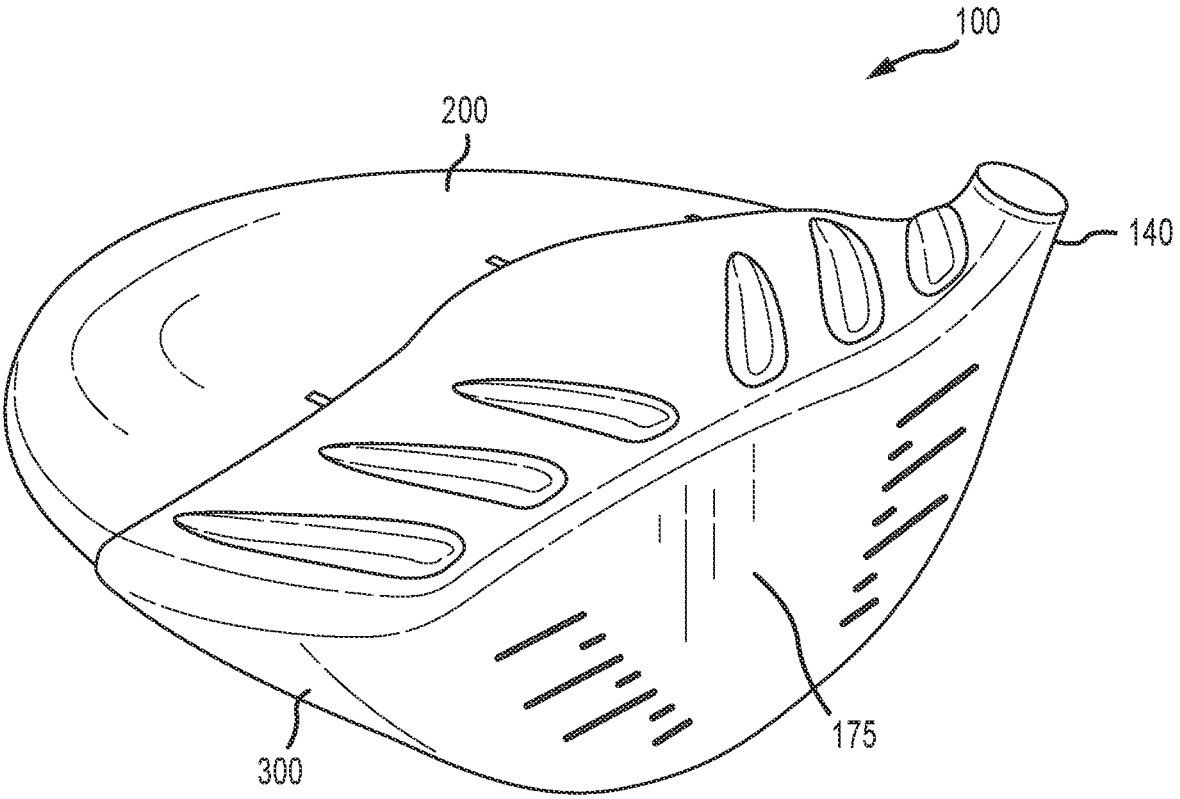
FIG. 1C illustrates a front perspective view of an assembled golf club head.

Described herein is a hollow golf club head comprising two major components. The first component is metallic. The second component is non-metallic. The metallic, first component comprises the striking portion and a sole extension. The non-metallic, second component comprises the rear portion of the crown, and wraps around to also comprise a portion of the sole. The first component comprises the load bearing, or structural area of the golf club head, and also comprises most of the mass of the golf club head. The first component comprises a rearwardly extending sole portion with a significant portion of the golf club mass at the most rearward portion of the extension, causing the first part to form a "T" shape when viewed from above. This arrangement provides discretionary mass available to be redistributed to improve the center of gravity (CG) location and moment of inertia (MOI). The improved CG and MOI provide for a more precise ball flight compared to traditional, all metallic golf club heads. The golf club head discussed herein may comprise a driver-type golf club head, a fairway-type golf club head, or a hybrid-type golf club head.

The more dense "T" shaped sole of the first component, coupled to the less dense crown wrapped around second component can optimize mass properties by reducing the crown mass, and shifting the golf club head center of gravity (CG) lower. The saved weight from the second component can be redistributed to other locations of the golf club head to further optimize the CG and increase the MOI. The CG of the golf club head can move lower and toward the rear of the golf club head comprising the first component and the second component, wherein the second component comprises a second material with a second density that is lower than the first material density, compared to an alternate golf club head comprising only the first material with a constant density.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Other features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

I) Golf Club Head

Described herein is an embodiment of a golf club head (100) comprising two components, a first component and a second component. The golf club head forms a striking face (170), a striking face return (177), a hosel (140), a crown (110), a sole (120), a heel end (160), a toe end (150), a trailing edge (130) at rear most portion of a rear end (180), a hosel (140), and a sole portion hosel adaptor attachment recess (195).

The golf club head (100) further defines a loft plane (198) tangent to the striking face center (175) of the striking face (170). A face height can be measured parallel to the loft plane between a top end of the striking face perimeter near the crown (110) and a bottom end of the striking face perimeter near the sole (120). In these embodiments, the striking face perimeter can be located along the outer edge of the striking face (170) where the curvature deviates from the bulge and/or roll of the striking face (170).

Figure 1D:
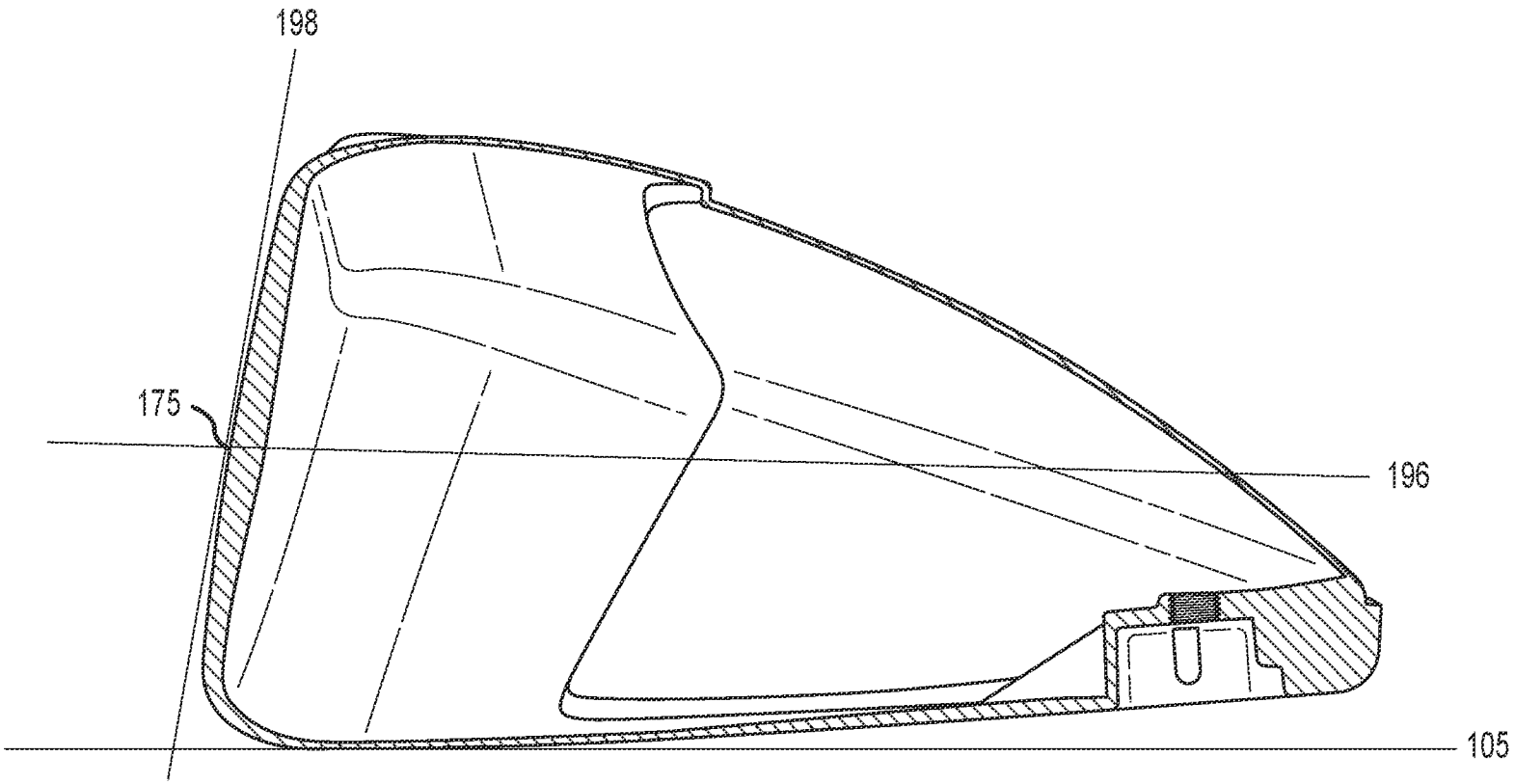
FIG. 1D illustrates a cross-sectional view of a golf club head with a loft plane, a ground plane, and a Z axis.
Figure 1E:
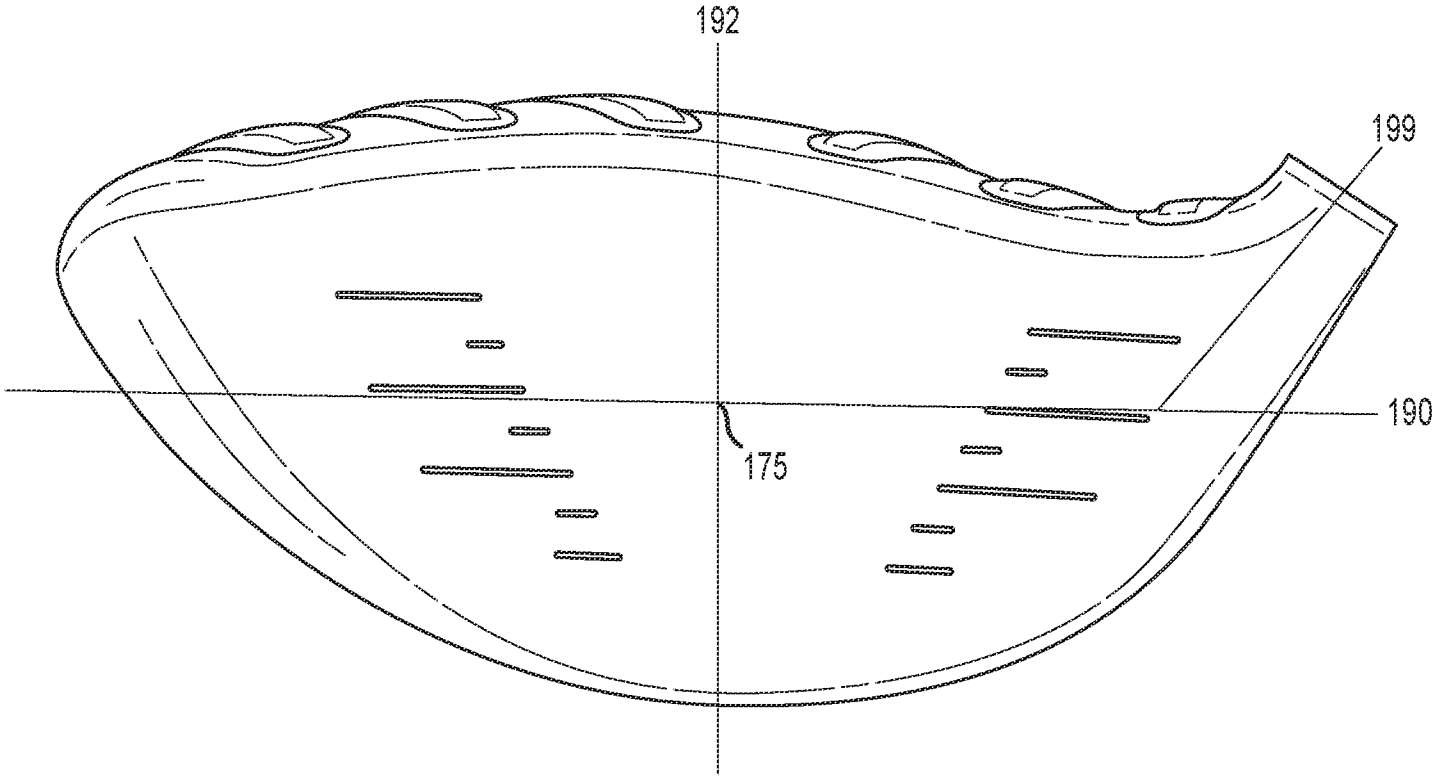
FIG. 1E illustrates a front view of an assembled golf club head with X, Y, and hosel axes.

Referring to FIGS. 1D and 1E, the striking face center (175) further defines a coordinate system having an origin at the striking face center (175) of the striking face (170), the coordinate system having an X axis, a Y axis, and a Z axis. The X axis (190) extends through the striking face center (175) of the striking face (170) in a direction from the heel end (160) to the toe end (150) of the golf club head (100), and parallel to a ground plane (105) when the club head (100) is at address. The Y axis (192) extends through the striking face center (175) of the striking face (170) in a direction from the crown (110) to the sole (120) of the golf club head (100), and perpendicular to the X axis (190), and the Z axis (196) extends through the striking face center (175) of the striking face (170) in a direction from the striking face (170) to the rear end (180) of the golf club head (100) and perpendicular to the X axis (190) and the Y axis (192).

The coordinate system defines an XY plane extending through the X axis (190) and the Y axis (192), an XZ plane extending through the X axis (190) and the Z axis (196), and a YZ plane extending through the Y axis (192) and the Z axis (196), wherein the XY plane, the XZ plane, and the YZ plane are all perpendicular to one another and intersect at the origin of the coordinate system at the striking face center (175) of the striking face (170). The XY plane extends parallel to a hosel axis and is positioned at an angle corresponding to the loft angle of the golf club head (100) from the loft plane. Further the X axis (190) is positioned at a 60 degree angle to the hosel axis (199) when viewed from a direction perpendicular to the XY plane.

A) First Component

Figure 2:
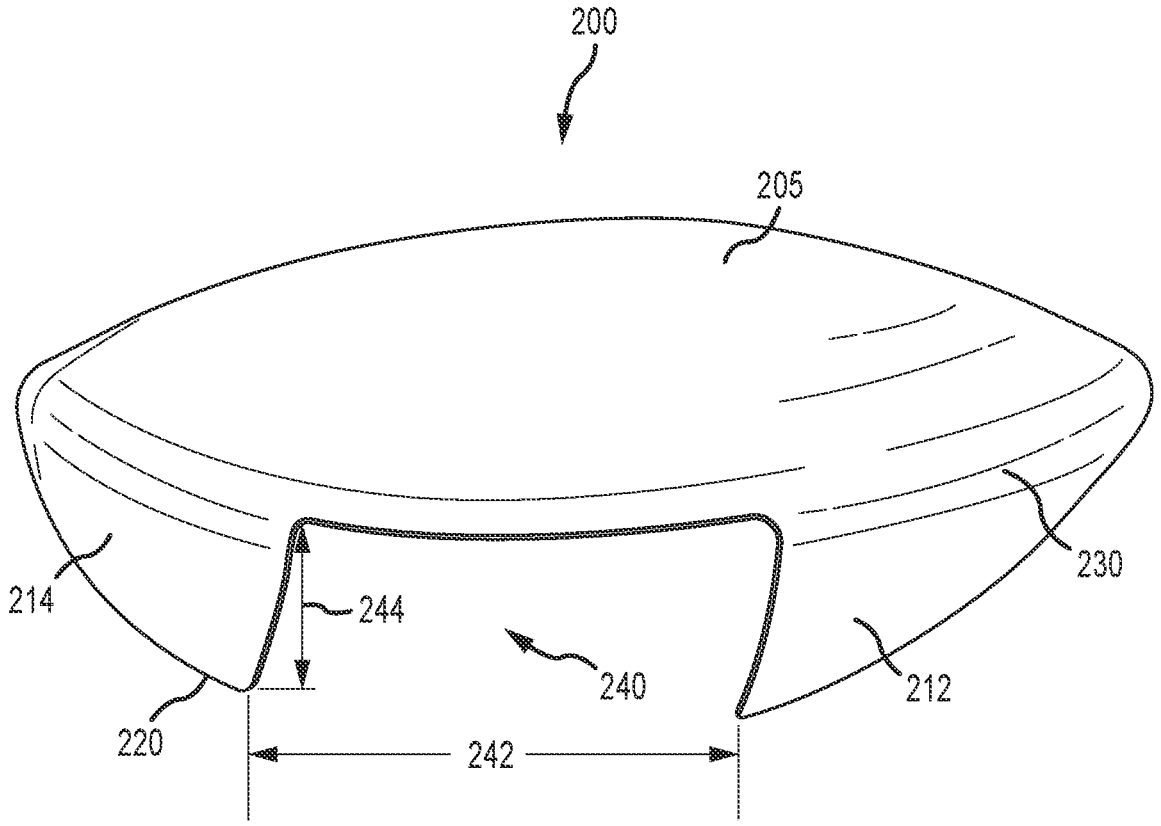
FIG. 2 illustrates a golf club head second component rear exterior view.
Figure 3:
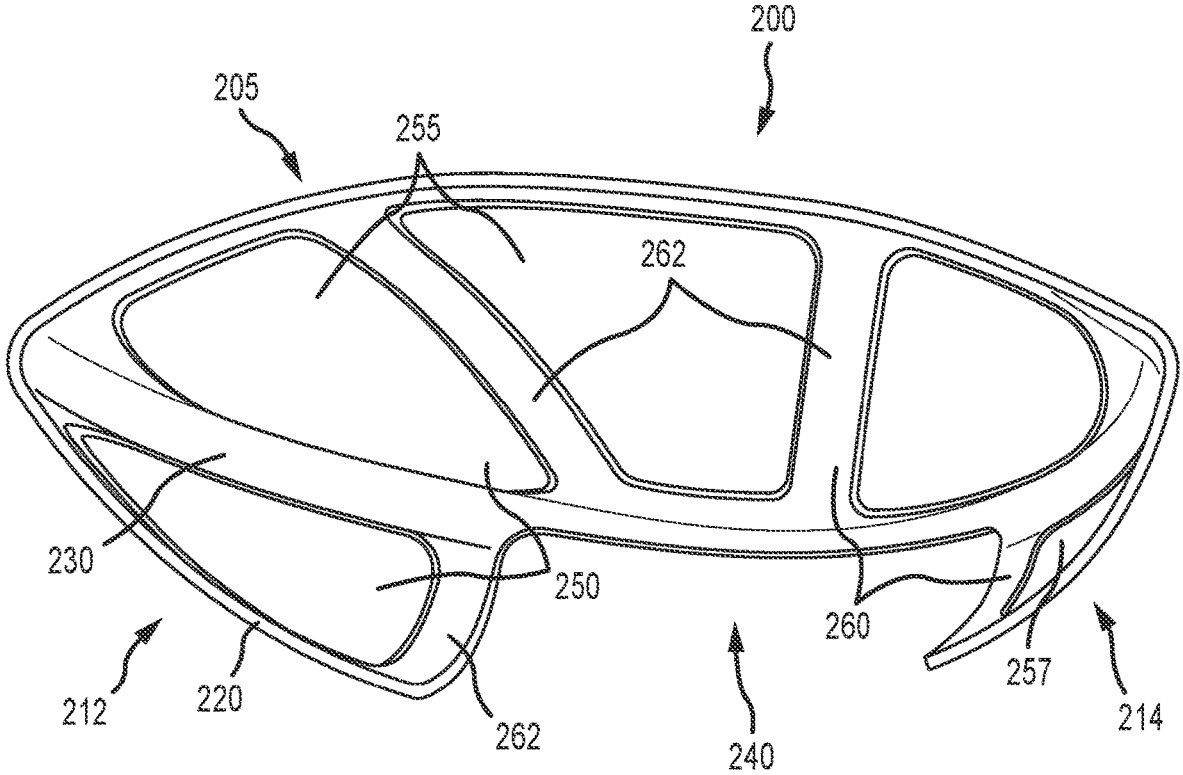
FIG. 3 illustrates a golf club head second component front interior view.

As illustrated in FIGS. 1A-1F, and 4-8, a first component (300) can comprise the striking face (170) having a return portion (177) that forms a portion of the crown (400), the hosel (140), a portion of the heel end (160), a portion of the toe end (150), a portion of the trailing edge (130), a recessed lip (450) (also referred to as a joint extension surface), and a portion of the sole (120). The striking face return portion (177) comprises a rearward extension positioned approximately perpendicular to the striking face (170) and extending from another perimeter of the striking face (170). The striking face return (177) forms a rearward profile in a heel end to toe end direction. In other embodiments, the rearward profile of the first component (300) can extend from the heel end (160) toward the toe end (150) in a straight-lined profile, in a positive parabolic profile, in a bell shaped profile, or any other profiles relative to the striking face (170). As illustrated in FIGS. 2 and 3, the second component (200) can comprise at least a portion of the crown (110), the sole (120), the trailing edge (130), and a rear cutout (240).

The first component (300) comprises a first material having a first density. The first material comprises a metallic material. The second component (200) comprises a second material comprising a second density. The second component (200) comprises a second component mass.

The first material density of the first component (300) is greater than the second material density of the second component (200). The mass percentage of the first component (300) can range from 85% to 96% of the mass of golf club head (100). For example, the first component percentage of the mass of the golf club head may be 85%, 86%, 87%, 88%, 89%, 90%, 91%, 92%, 93%, 94%, 95%, or 96%. The mass percentage of the second component (200) can range from 4% to 15% of the mass of golf club head (100). The first component (300) comprises a sole portion rear extension (500) having a mass portion (510) at an extreme rear position of the rear extension (500). The mass portion (510) can comprise between 20% and 35% of the mass of the hollow multi-component golf club head (100). Placing so much of the mass of the golf club head at an extreme rear position of the golf club head provides mass characteristics that are functionally desirable.

The first component (300) may be integrally formed as a single piece, so the first component comprises a single material. Alternately, first component (300) may comprise a separately formed striking face insert comprising a different material (i.e. a third material) than the remainder of the first component (300).

The first, metallic component (300) is coupled to the second, non-metallic component (200) wrapped around the first component (300) to form the hollow golf club head (100). The second component trailing edge portion (230) connects the second component crown portion (205) and the second component sole portions (212) and (214) as they wrap around the first component (300).

Figure 1F:
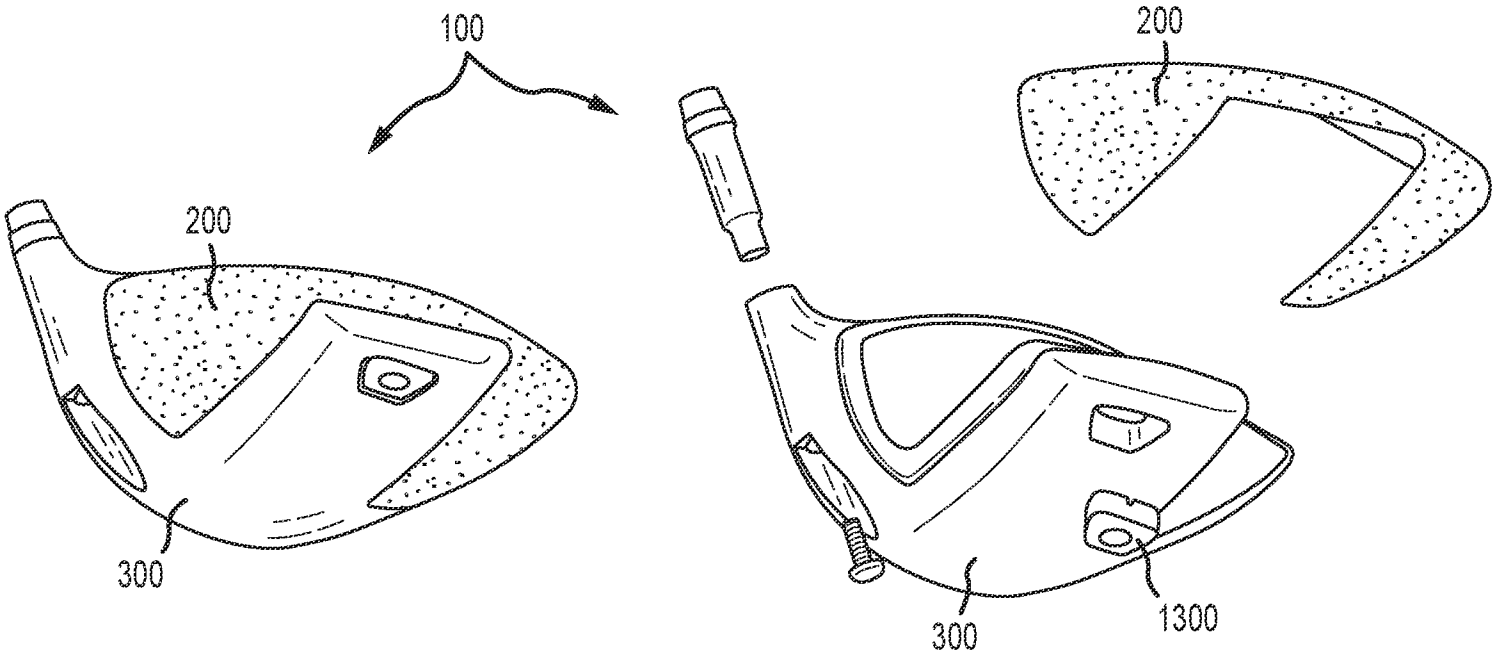
FIG. 1F illustrates an assembled and exploded view of a golf club head.

Referring to FIG. 1F, the golf club head (100) comprises a first component (300) and a second component (200) configured to be coupled together to form a hollow golf club head. Wherein the first component is T-shaped, and comprises a metallic material. The sole of the first component (300) has a rear sole extension with a mass member at the extreme rear end of the sole extension. This configuration results in the center of gravity of the assembled golf club head being located farther to the rear of the assembled golf club head, and also located lower in the assembled golf club head.

Figure 4:
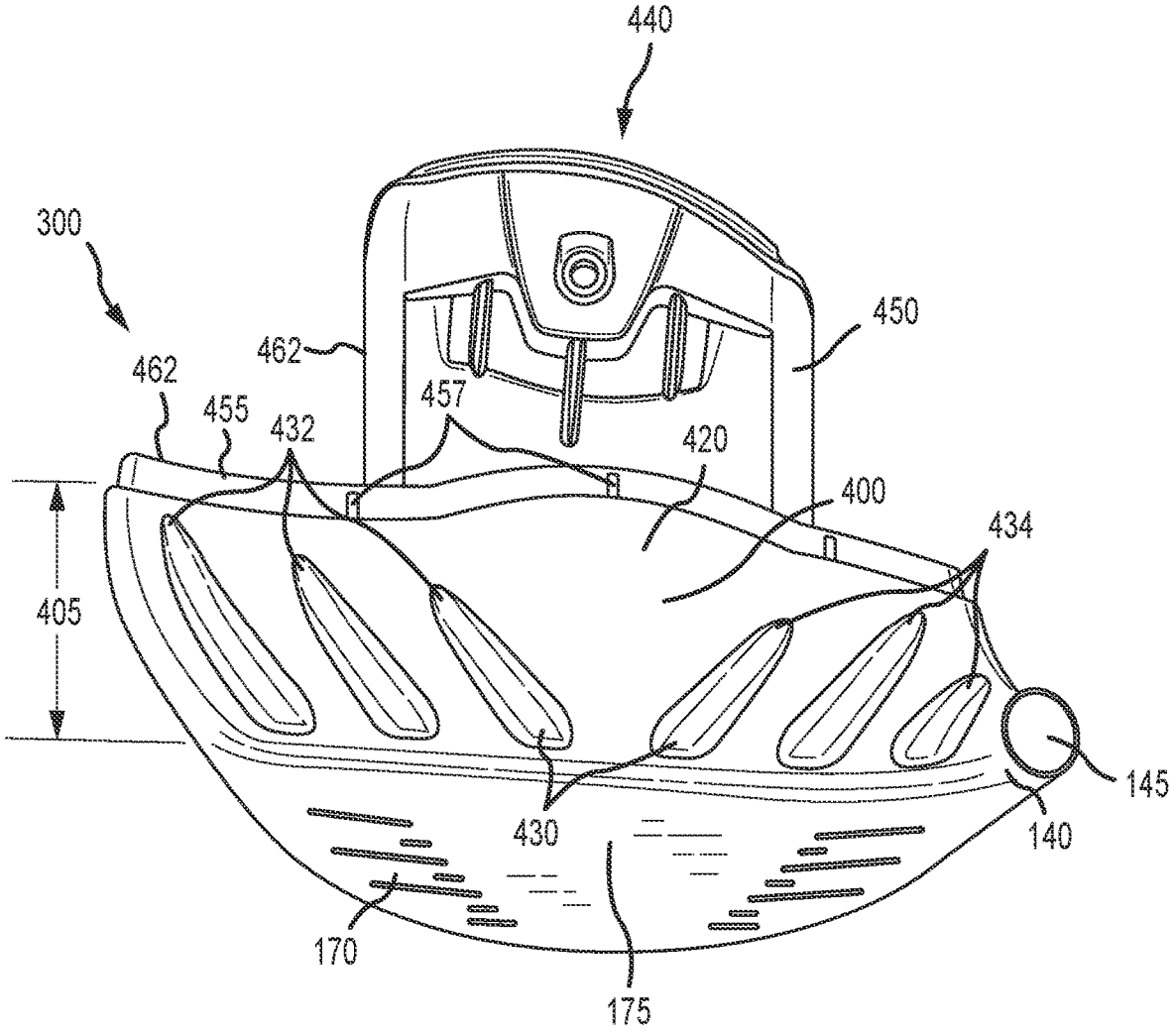
FIG. 4 illustrates a golf club head first component front top view.

Referring to FIGS. 1E and 4, the first component (300) comprises a hosel bore (145) defining a hosel axis (199), a striking face center (175), a striking face crown portion (420), a striking face return crown portion (400) having a striking face return crown portion width (405), and a first component trailing edge (440). Some embodiments may further comprise first component crown portion turbulators (430) having a first component crown portion turbulators toe portion (432) and a first component crown portion turbulators heel portion (434).

The first component can comprise a recessed lip (also referred to as a joint extension surface) configured to overlap with a portion of the second component, and together form the golf club head. The first component (300) can comprise a first component lip (450) bordering the first component perimeter edge (462) having a first component crown portion lip (455), and first component tabs (457). The first component tabs (457), and matching grooves in the second component, align the first component (300) to the second component (200) during assembly, and also add mechanical support to prevent sideways movement between the first component (300) and the second component (200).

Figure 5:
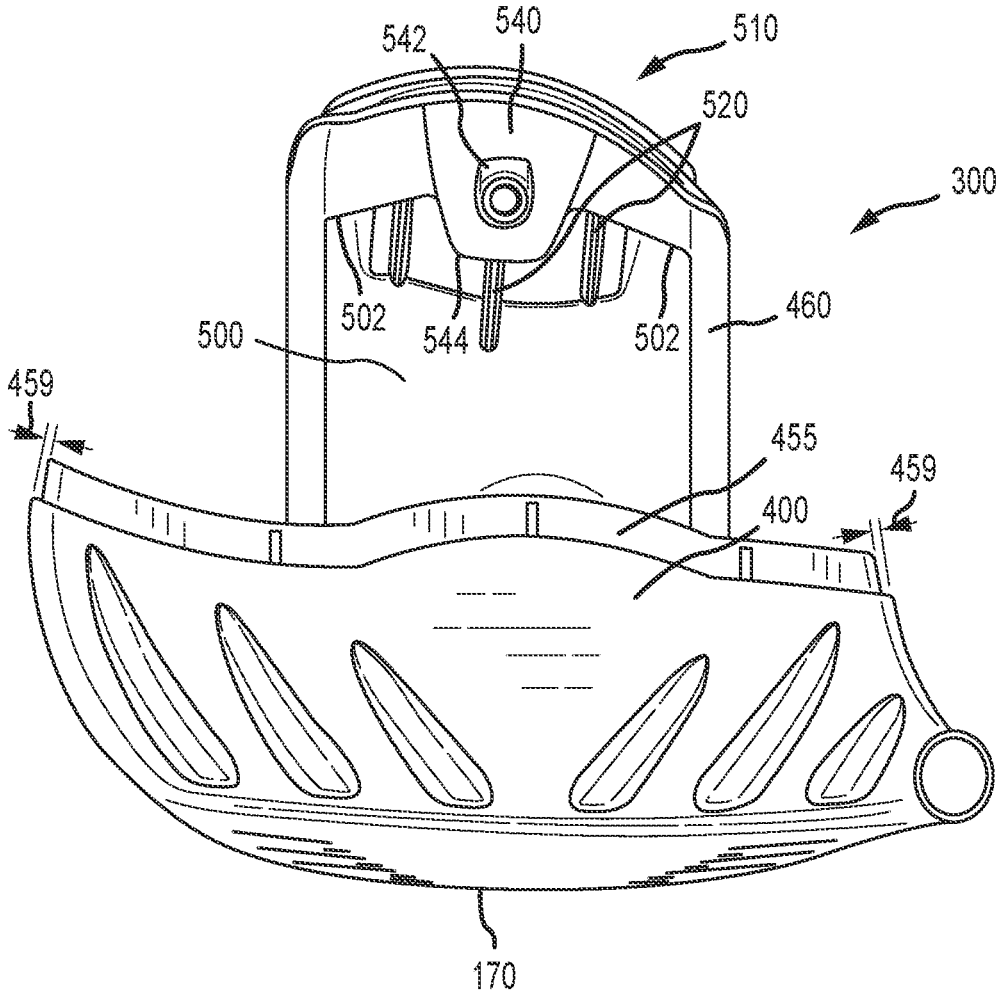
FIG. 5 illustrates a golf club head first component top view.

The first component lip is recessed from an outer surface of the golf club head to accommodate the combined thickness of the overlapping lip of the second component, and any adhesive securing the two components together. Referring to FIG. 5, the first component (300) comprises a first component lip recessed offset (459), a first component sole portion lip (460), a first component sole portion rear extension (500), a first component sole portion rear extension mass portion (510) having a mass portion interior forward edge (502), one or more mass portion interior ribs (520), and a detachable weight recess (540) having a threaded fastener receiver boss (542) and a detachable weight recess interior forward edge (544). Referring also to FIG. 1F, a first component lip (455) is configured to be covered by a portion of the second component (200) when the first component (300) is coupled to the second component (200) to form the golf club (100). The first component (300) may preferably be coupled to the second component (200) with an adhesive placed between the overlapping surfaces of the first component and the second component.

Still referring to FIG. 5, the first component lip has a width (730), which can range from 0.125 inch to 0.275 inch. For example, the first component lip width (730) may be 0.125 inch, 0.150 inch, 0.175 inch, 0.200 inch, 0.225 inch, 0.250 inch, or 0.275 inch.

The first component recessed offset (459) is an offset distance of the lip (455) from the outer surface of the first component (300) toward the interior of the golf club head. The recessed offset (459) can range from 0.060 inch to 0.160 inch toward the interior of the golf club head (100). In other embodiments, the recessed offset (459) can range from 0.060 inch to 0.150 inch, 0.060 inch to 0.140 inch, 0.080 inch to 0.160 inch, 0.090 to 0.150 inch, or 0.090 inch to 0.160 inch. For example, the recessed offset (459) can be 0.060 inch, 0.070 inch, 0.080 inch, 0.090 inch, 0.100 inch, 0.110 inch, 0.120 inch, 0.130 inch, 0.140 inch, 0.150 inch, or 0.160 inch.

Still referring to FIG. 5, the first component has a rear extension on the sole, which allows a larger portion of the mass of the assembled golf club head to be moved down to the sole and towards the rear of the assembled golf club head. The rear extension (500) extends from and is integral with the striking face return, allowing impact stresses to propagate all the way to the rear of the sole, helping to balance the distribution of impact stress in the golf club head.

Still referring to FIG. 5, the first component lip (450) comprises the first component crown portion lip (455), the first component sole portion lip (460). The first component lip (450) may have other portions.

Figure 6:
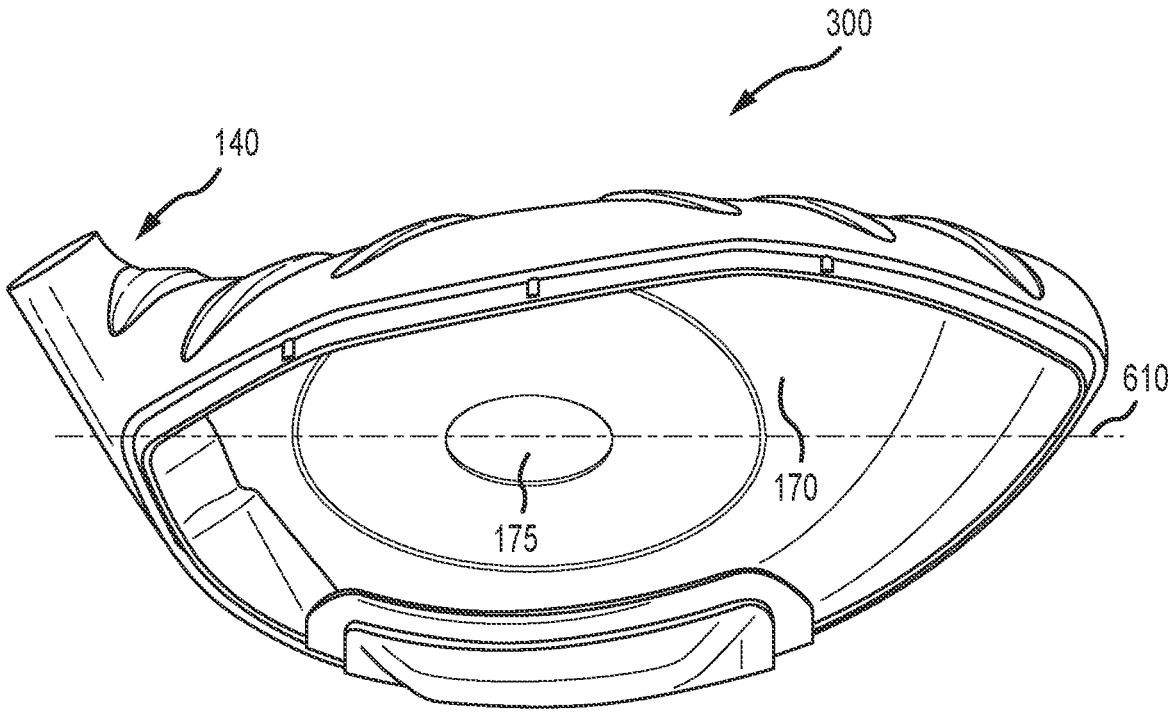
FIG. 6 illustrates a golf club head first component rear view showing an mid-plane through a strike face center parallel to the ground plane.
Figure 7:
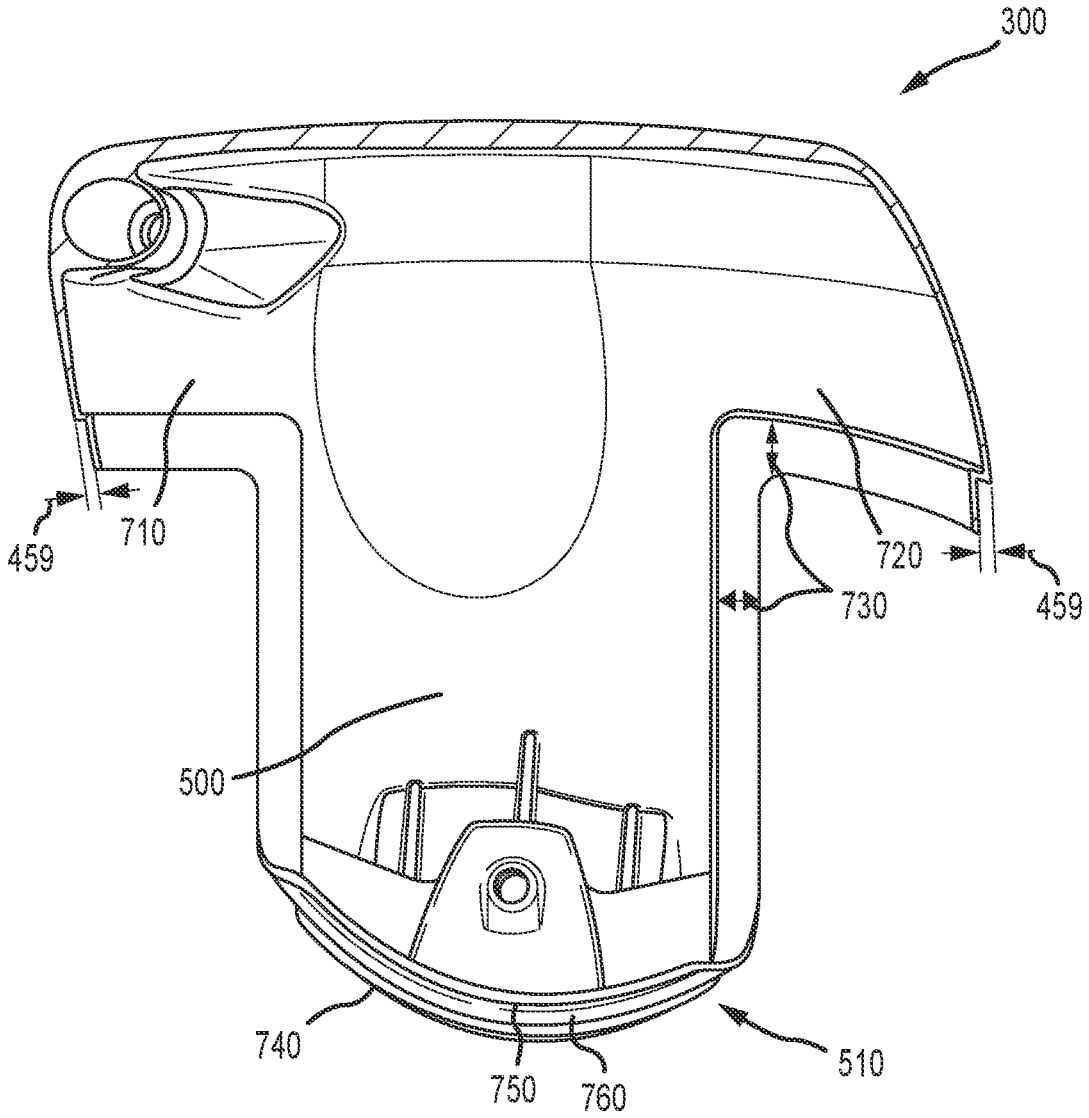
FIG. 7 illustrates a cross section of the first golf club component o FIG. 6 along reference line XII.

Referring to FIG. 6, a plane (610) parallel to the ground plane (105), and intersecting the strike face center (175) defines a view of the lower portion of the first component (300) as show in FIG. 7. Referring to FIG. 7, the rear extension (500) extends from a rear perimeter of striking face return sole portion (810) toward the rear end (180) of the golf club head (100).

Referring to FIG. 7, the first component (300) comprises a first component sole portion heel extension (710), a first component sole portion toe extension (720), a first component lip (460) having a first component lip width (730), a first component trailing edge portion (740), and a first component sole portion rear extension mass portion (510) having a vertical lip (750), and a mass portion trailing edge shelf (760).

Figure 8:
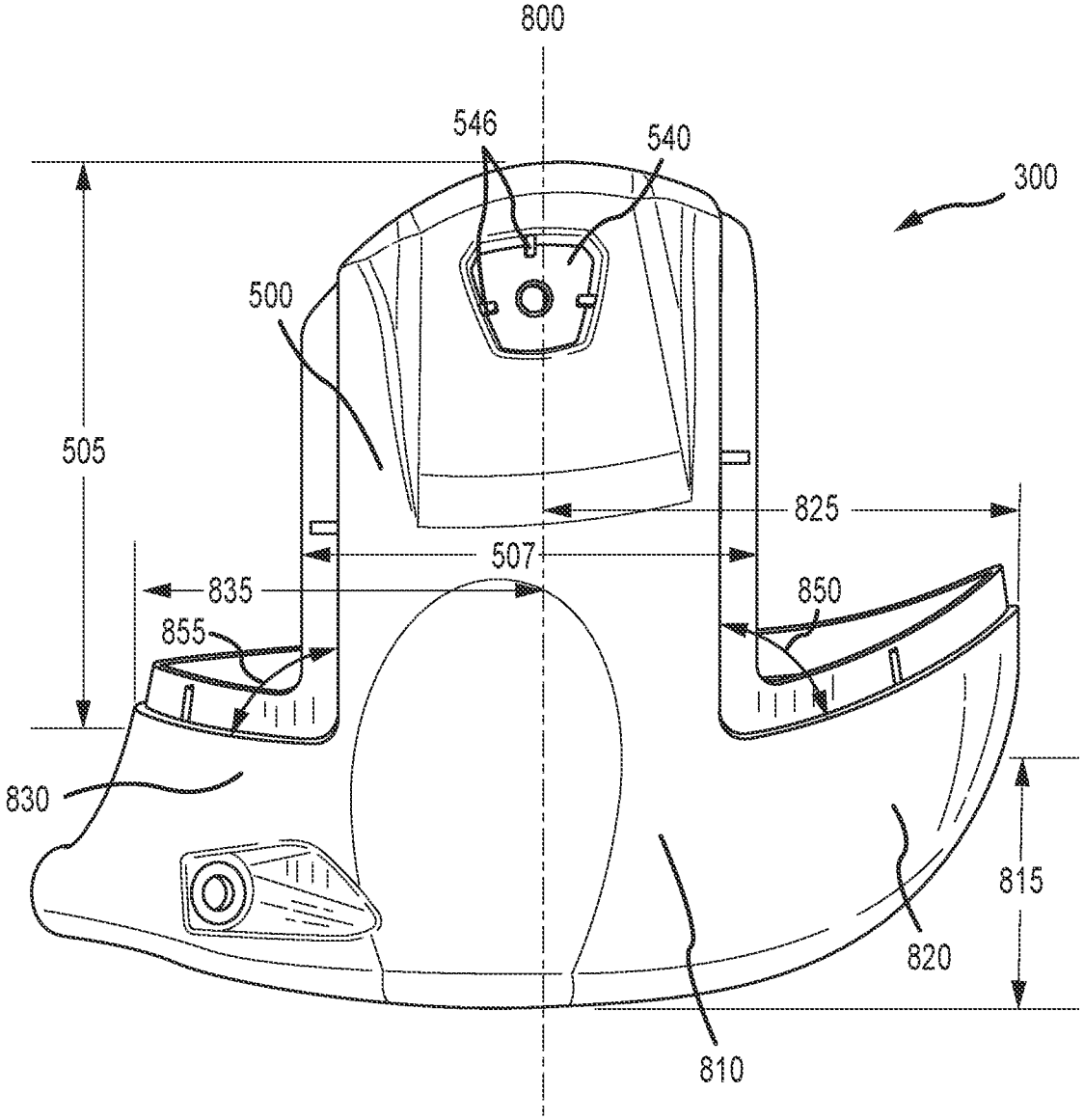
FIG. 8 illustrates a golf club head first component bottom view.

The rear extension (510) has a larger mass at a rear most position of the extension. Placing the mass at the rear most position allows for the manipulation of the rear sole extension position to greatly affect the mass properties of the assembled golf club head. Referring to FIG. 8, the first component (300) comprises a first component sole portion rear extension (500) having a first component sole portion rear extension length (505) and a first component sole portion rear extension width (507). The first component (300) comprises a striking face return sole portion (810), having a striking face return sole portion width (815), a first component sole portion toe extension (820) having a first component sole portion toe extension length (825), and a first component sole portion heel extension (830) having a first component sole portion heel extension length (835). The rear extension length (505) is measured from a rear perimeter of the striking face return portion (810), towards the rear end (180). The return sole portion width (815) is measured from the loft plane (198) rearwardly to a rear perimeter of the striking face return portion, which is a sole portion of a first component perimeter edge (462). The rear extension length (505) and the return sole portion width (815) together comprise a total sole length of the golf club head (100) measured from the loft plane (198) to the rear end (180) along the sole (120). The rear extension width (507) is the width of the rear extension (500). The rear extension width (507) is measured in a heel to toe direction rearward of a rear perimeter of the striking face return sole portion (810), which is a sole portion of a first component perimeter edge (462). The rear extension width (507) is less than an entire width of the sole (120) of the golf club (100). The rear extension width (507) can range from 25% to 85% of an entire width of the sole (120). The rear extension width (507) may be 25%, 30%, 35%, 40%, 45%, 50%, 55%, 60%, 65%, 70%, 75%, 80% or 85% of an entire width of the sole (120).

Referring to FIGS. 7 and 8, the first component sole portion rear extension (500), toe extension (720), and heel extension (710) together form a T-like structure. The first component sole portion rear extension (500) forms a toe-ward angle (850) with the toe extension (720), and a heel-ward angle (855) with the heel extension (710). The first component (300) further comprises a detachable weight recess (540) having a plurality of detachable weight recess tabs (546).

Referring to FIGS. 5, 7, and 8, the striking face return (177) extends rearwardly from a striking face perimeter, essentially perpendicular to the striking face (170). The striking face (170) and striking face return (177) comprise a forward section of the assembled golf club head. The striking face return (177) comprises a striking face return crown portion (400) having a striking face return crown portion width (405), and a striking face return sole portion (810) having a striking face return sole portion width (815). The striking face return crown portion (400) comprises a rearward perimeter that forms a profile on the crown (110) from the heel end (160) of the crown (110) to a toe end (150) of the crown (110). The striking face return crown portion width measured from the striking face (170) toward the rear end (180) may vary. The striking face return crown portion maximum width (405) may be smaller at the toe end (150) and at the heel end (160), and larger in a middle region between the toe end (150) and the heel end (160). The striking face return crown portion maximum width (405) can range from 1.0 inch to 1.5 inches. For example, the striking face return crown portion maximum width (405) may be 1.0 inch, 1.1 inches, 1.2 inches, 1.3 inches, 1.4 inches, or 1.5 inches. The second component crown portion width (405) can be similar to the crown portion as described in U.S. application Ser. No. 11/693,490, now U.S. Pat. No. 7,601,078.

Manipulating the position of the rear sole extension provides a means of manipulating the mass properties of the assembled golf club head. Referring to FIGS. 4, 5, 7, and 8, the sole portion of the first component can extend from a center near the striking face toward the toe end forming a first component sole portion toe end extension (720), toward the heel end forming a first component sole portion heel end extension (710), and toward the rear end forming a first component sole portion rear extension (500). The first component sole portion toe extension (720), first component sole portion heel extension (710), and first component sole portion rear extension (500) can form a "T" shaped profile. In some embodiments, the toe extension can have a first component sole portion toe end extension length (825) in a range of 1.50 inch to 2.00 inch from the YZ plane toward the toe end (150). For example, the first component sole portion toe extension (720) can have first component sole portion toe end extension length (825) of 1.50 inch, 1.60 inch, 1.70 inch, 1.80 inch, 1.90 inch, or 2.00 inch toward the toe end (150). In some embodiments, the first component sole portion heel end extension (710) can have a first component sole portion heel extension length (835) in a range of 0.90 inch to 1.40 inch from the YZ plane toward the heel end (160). For example, the first component sole portion heel end extension (710) can extend 0.90 inch, 1.10 inch, 1.20 inch, 1.30 inch, or 1.40 inch. The first component sole portion rear extension (500) can be 2.30 inch to 2.90 inch measured from the striking face return (177). For example, the first component sole portion rear extension (500) can extend from the striking face return (177) by a distance of 2.30 inch, 2.40 inch, 2.50 inch, 2.60 inch, 2.70 inch, 2.80 inch, or 2.90 inch.

Shifting the first component sole portion rear extension closer to the toe end (150) or the heel end (160) of the golf club head (100) provides one means of manipulating the mass properties of the assembled golf club head, and changing the ball flight. When manufacturing the first component (300), moving the first component sole portion rear extension (500) toward the toe end (150) or toward the heel end (160) of the golf club (100) will change mass properties of the assembled golf club head. If the first component sole portion rear extension (500) is moved toward the toe end (150) by decreasing the first component sole portion toe end extension length (825) the center of gravity of the golf club head (100) will also be moved towards the toe end (150). If the first component sole portion rear extension (500) is moved toward the heel end (160) of the golf club head (100), the center of gravity of the golf club head (100) will also be moved towards the heel end (160).

The return portion of the first component (300) can comprise a thickness extending between the outer surface and the inner surface of the return portion. The thickness of the first component can range from 0.015 inch to 0.040 inch. In other embodiments, the thickness of the first component can range from 0.010 inch to 0.040 inch, 0.010 inch to 0.020 inch, 0.015 inch to 0.025 inch, 0.020 inch to 0.030 inch, 0.025 inch to 0.035 inch, 0.030 inch to 0.040 inch, 0.040 inch to 0.10 inch, or 0.10 inch to 0.25 inch. For example, the thickness of the first component can be 0.010 inch, 0.015 inch, 0.020 inch, 0.025 inch, 0.030 inch, 0.035 inch, or 0.040 inch. The thickness of the first component can further vary at the striking face (170), the first component crown portion (420), the first component sole portion (310), the first component sole portion heel extension (710), the first component sole portion toe extension (720), and the first component sole portion rear extension mass portion (510).

The first component (300) comprises a surface area ranging from 27 $inch^2$ to 41 $inch^2$ out of the entire surface area of the golf club head (100). In some embodiments, the surface area of the first component (300) can range from 25 inch$^2$ to 43 inch$^2$, 25 inch$^2$ to 28 inch$^2$, 28 inch$^2$ to 31 inch$^2$, 31 inch$^2$ to 34 inch$^2$, 34 inch$^2$ to 37 inch$^2$, 37 inch$^2$ to 40 inch$^2$, or 40 inch$^2$ to 43 inch$^2$. For example, the 25 inch$^2$, 27 inch$^2$, 29 inch$^2$, 31 inch$^2$, 33 inch$^2$, 35 inch$^2$, 37 inch$^2$, 39 inch$^2$, 41 inch$^2$, or 43 inch$^2$.

The first component (300) can comprise a material such as steel, tungsten, aluminum, titanium, vanadium, chromium, cobalt, nickel, other metals, or metal alloys. In many embodiments wherein the golf club head (100) is a driver-type club head, the first component (300) can comprise a titanium material. In many embodiments wherein the golf club head (100) is a fairway wood-type club head, the first component (300) can comprise a steel material.

In many embodiments, the first component (300) can be casted. In other embodiments, the first component (300) can be forged, pressed, rolled, extruded, machined, electroformed, 3-D printed, or any appropriate forming technique. Referring FIG. 15, in embodiments wherein the first component (300) is cast, the first component (300) may further comprise a plurality of casting support bars, including one or more heel end casting support bars (1510), and one or more toe end casting support bars (1512).

1) First Component Rear Sole Extension

As discussed above, the first component comprises the striking face and striking face return. These portions of the golf club head receive and distribute the impact forces when the golf club strikes a ball. The rear extension (500) is integrally formed with the rest of the first component, and is attached to the sole portion of the striking face return (810). Further, the mass of the rear extension (500), resists torquing forces caused by off center hits on the striking face. In many embodiments, the first component sole portion toe end extension (720), and the first component sole portion heel end extension (710) can be parallel with the striking face (170), comprising a constant width from front to back. In other embodiments, the toe end extension (720), and heel end extension (710) can increase and/or decrease in width from toward the toe end (150) and heel end (160), comprising a varying width. In some embodiments, the first component sole portion toe (720) and heel end (710) extensions can comprise a width ranging from 1.0 inch to 1.5 inches. For example, the toe (720) and heel end (710) extensions can be 1.00 inch, 1.10 inches, 1.20 inches, 1.30 inches, 1.40 inches, or 1.5 inches.

In many embodiments, the first component sole portion rear extension (500) can increase in width, decrease in width, and/or comprise a consistent width from a rear boundary of the striking face return sole portion (810) toward the rear end (180). In some embodiments, the rear end extension (500) can comprise a width ranging from 1.0 inch to 3.5 inches. For example, the rear end extension can be 1.0 inch, 1.25 inches, 1.50 inches, 1.75 inches, 2.00 inches, 2.25 inches, 2.50 inches, 2.75 inches, 3.0 inches, 3.25 inches, or 3.50 inches.

In some embodiments as illustrated in FIG. 2, the first component sole portion rear extension (500) can extend in a perpendicular orientation relative to the striking face (170), centered between the toe end (150) and the heel end (160). In other embodiments, the rear extension (500) can extend in an orientation closer to the toe end (150), or closer to the heel end (160). The rear extension (500) can be offset towards the heel end (160) from 0.05 inch to 1.0 inch. For example, the rear extension (500) can be offset towards the heel end (160) 0.1 inch, 0.2 inch, 0.3 inch, 0.4 inch, 0.5 inch, 0.6 inch, 0.7 inch, 0.8 inch, 0.9 inch, or 1.0 inch. The first component sole portion rear end extension (500) can be offset towards the toe end (150) from 0.05 inch to 1.0 inch. For example, the rear extension (500) can be offset towards the toe end (160) 0.1 inch, 0.2 inch, 0.3 inch, 0.4 inch, 0.5 inch, 0.6 inch, 0.7 inch, 0.8 inch, 0.9 inch, or 1.0 inch.

If the first component sole portion rear end extension (500) is offset towards the toe end (150), the center of gravity of the golf club head (100) can be offset towards the toe end (150) up to 0.150 inch. For example, the center of gravity may be offset towards the toe end (150) 0.010 inch, 0.020 inch, 0.030 inch, 0.040 inch, 0.050 inch, 0.060 inch, 0.070 inch, 0.080 inch, 0.090 inch, 0.100 inch, 0.110 inch, 0.120 inch, 0.130 inch, 0.140 inch, or 0.150 inch. If the first component sole portion rear end extension (500) is offset towards the heel end (160), the center of gravity of the golf club head (100) can be offset towards the heel end (160) up to 0.150 inch. For example, the center of gravity may be offset towards the heel end (160) 0.010 inch, 0.020 inch, 0.030 inch, 0.040 inch, 0.050 inch, 0.060 inch, 0.070 inch, 0.080 inch, 0.090 inch, 0.100 inch, 0.110 inch, 0.120 inch, 0.130 inch, 0.140 inch, or 0.150 inch.

Another means of manipulating the mass properties of the golf club head is to change the angle the rear sole extension relative to striking face of the first component. The first component sole portion rear extension toe-ward angle (850) and the first component sole portion rear extension heel-ward angle (855) are supplementary angles (i.e. the two angles add up to 180 degrees). In one embodiment, the toe-ward angle (850) and the heel-ward angle (855) are each 90 degrees, so the rear extension (500) is essentially perpendicular to the striking face (170). In alternate embodiments, the toe-ward angle (850) and the heel-ward angle (855) can each vary between 45 degrees and 135 degrees, as long as the two angles continue to be supplementary angles. For example, the toe-ward angle (850) can be 100 degrees, while the heel-ward angle (855) is the supplementary 80 degrees. In this example, the mass portion (510) is angularly offset towards the heel end (180) of the golf club head (100). Other combination of toe-ward angle (850) and heel-ward angle (855) may be 110 degrees and 70 degrees, 120 degrees and 60 degrees, 130 degrees and 50 degrees, or 135 degrees and 45 degrees. The center of gravity of the golf club head would be offset toward the rear mass portion (510) position. For example, the center of gravity may be offset towards the heel end (160) 0.010 inch, 0.020 inch, 0.030 inch, 0.040 inch, 0.050 inch, 0.060 inch, 0.070 inch, 0.080 inch, 0.090 inch, 0.100 inch, 0.110 inch, 0.120 inch, 0.130 inch, 0.140 inch, or 0.150 inch. In a similar fashion, the toe-ward angle may decrease while the heel-ward angle increases. For example, the combination of toe-ward angle (850) and heel-ward angle may be 80 degrees and 100 degrees, 70 degrees and 110 degrees, 60 degrees and 120 degrees, 50 degrees and 130 degrees, or 45 degrees and 135 degrees. For example, the center of gravity may be offset towards the toe end (160) by 0.010 inch, 0.020 inch, 0.030 inch, 0.040 inch, 0.050 inch, 0.060 inch, 0.070 inch, 0.080 inch, 0.090 inch, 0.100 inch, 0.110 inch, 0.120 inch, 0.130 inch, 0.140 inch, or 0.150 inch. This angular offset may be desirable to place a rear mass more toward the rear, heel-ward portion or rear toe-ward portion to position a club head center of gravity in that direction to influence ball flight characteristics. Other angular offsets in different embodiments may differently combine the first component sole portion rear extension toe-ward angle (850) and the first component sole portion rear extension heel-ward angle (855), which can produce different club head center of gravity positions and different ball flight characteristics.

2) First Component Rear Sole Extension Rear Mass

As discussed above, the first component comprises most of the mass of the assembled golf club head. The rear extension (500) allows for some of the golf club mass to be positioned away toward the rear of the club head, and in the sole of the club head. The rear extension (500) comprises a mass portion at the rear of the golf club head, allowing the mass there to further influence the CG and MOI of the golf club head. The first component sole portion rear extension mass portion (510) alone can comprise between 20% to 35% of the total mass of the golf club head (100). Placing this mass at the rear most portion of the rear extension (500) is an important aspect to controlling the mass properties of the golf club head (100) during manufacturing the first component (300).

Figure 9:
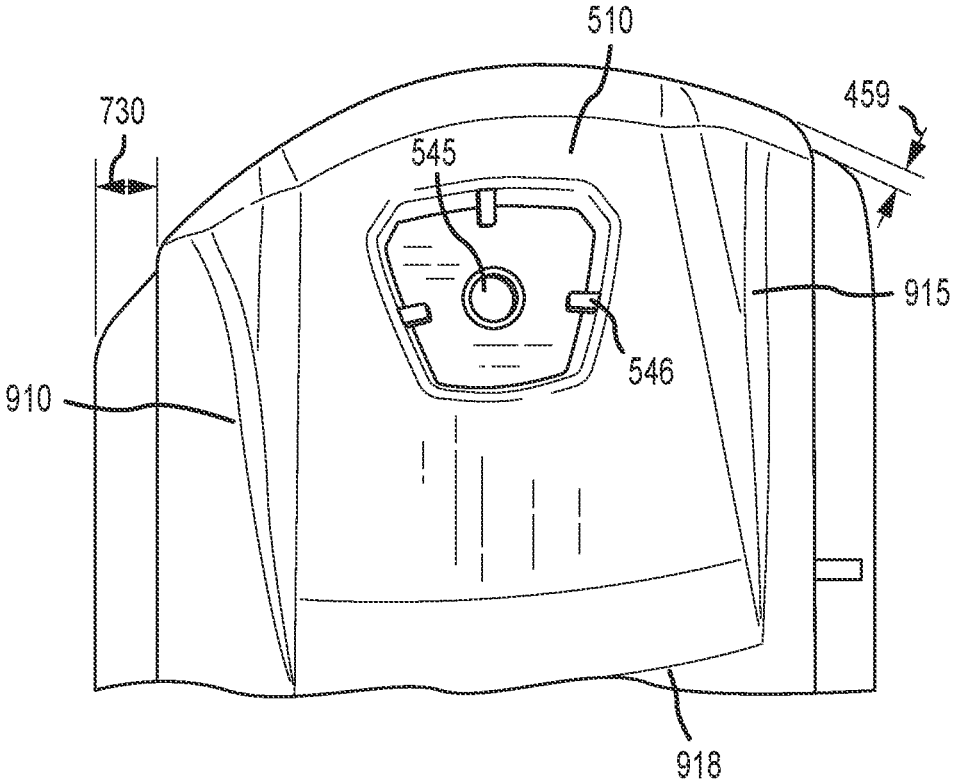
FIG. 9 illustrates a golf club head first component sole portion rear extension mass portion bottom view.

Referring to FIG. 9, the first component sole portion rear extension mass portion (510) comprises a threaded receiver (545), one or more weight recess tabs (546), and the mass portion (510) having a heel side external boundary (910), a toe side external boundary (915), and a forward external boundary (918).

Figure 10:
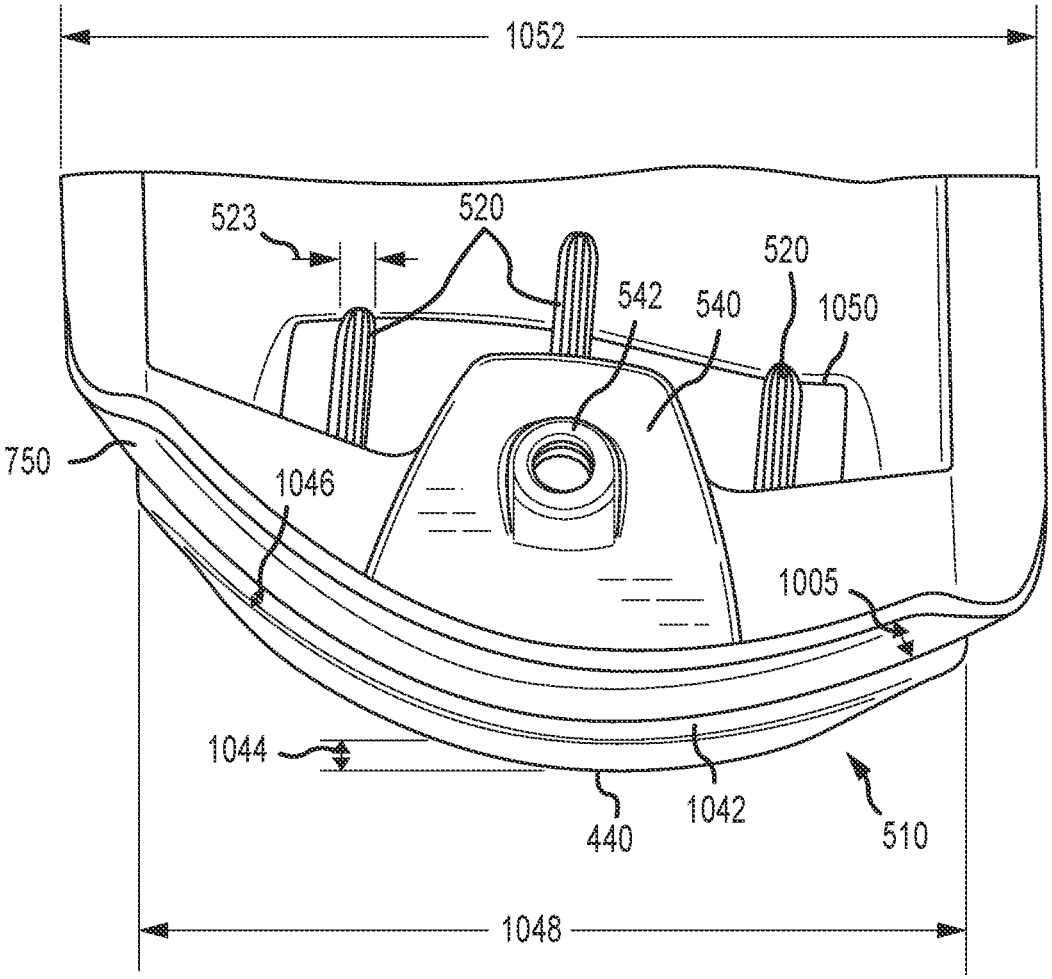
FIG. 10 illustrates a golf club head first component sole portion rear extension mass portion close rear view.

Referring to FIG. 10, the mass portion (510) further comprises a plurality of internal ribs (520) having an internal rib width (523). The plurality of internal ribs (520) may comprise two ribs, three ribs, four ribs, five ribs, or more than five ribs. The plurality of internal ribs (520) mate with, or attach to the interior surface of the rear extension mass portion detachable weight recess (540). The internal ribs (520) can reduce unwanted vibration at the mass portion (510), which is desirable because so much of the mass of the golf club head (100) is located so far to the rear of the golf club head. The mass portion (510) further comprises a vertical lip (750) having a vertical lip height (1005), a mass portion trailing edge shelf (1042) having a shelf length (1048), a shelf height (1044), and a shelf width (1046). The shelf length (1048) is approximately the same as a rear extension width (507), and varies as the width of the mass portion (510) varies.

The shelf (1042) provides a mating surface for a portion of the second component when the first and second components are coupled to form the assemble golf club head. The mass portion (510) further comprises an interior forward boundary (1050), and a vertical lip length (1052).

Figure 11:
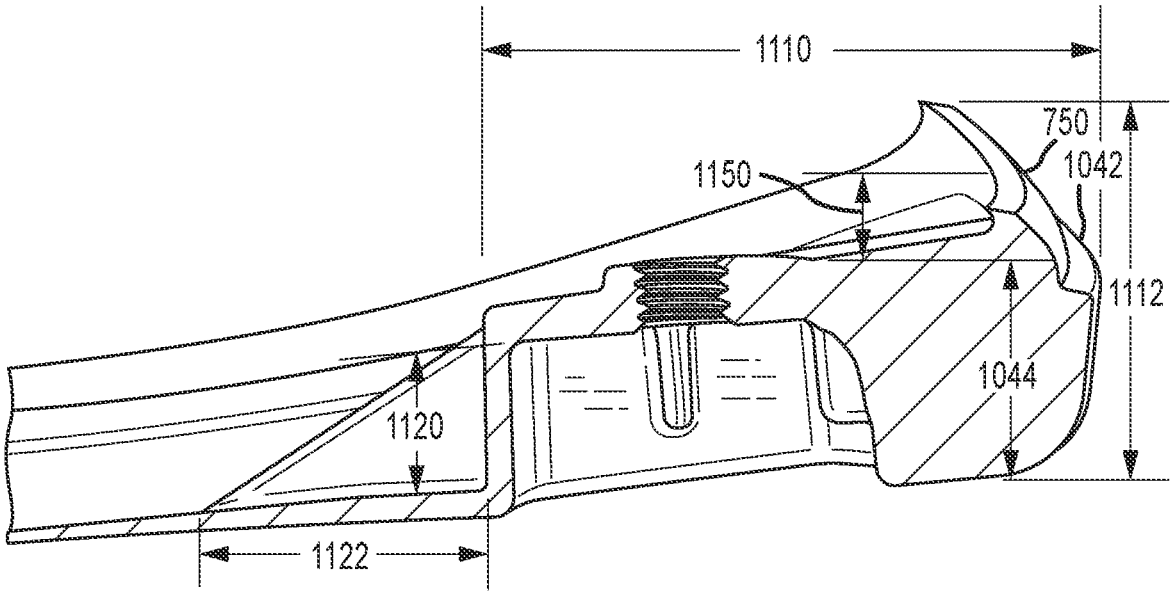
FIG. 11 illustrates a cross section of a golf club head first component sole portion rear extension mass portion.

Referring to FIG. 8, the view of the rear mass (510) is bisected by the YZ plane (800). Referring to FIG. 11, the mass portion (510) further comprises an internal length (1110), a mass portion maximum height (1112), and a vertical lip height (1150). The internal ribs further comprises a rib height (1120) and a rib length (1122).

The internal rib width (523) can range from 0.025 inch to 0.100 inch. For example, the internal rib width (523) may be 0.025 inch, 0.050 inch, 0.075 inch, or 0.100 inch. The internal rib height (1120) ranges from 25% to 100% of a detachable weight recess depth (1216). The internal rib length (1122) can range from 0.100 inch to 1.500 inch. For example, the internal rib length (1122) may be 0.100 inch, 0.200 inch, 0.300 inch, 0.400 inch, 0.500 inch, 0.600 inch, 0.700 inch, 0.800 inch, 0.900 inch, 1.000 inch, 1.100 inches, 1.200 inches, 1.300 inches, 1.400 inches, or 1.500 inches.

The mass portion (510) has a mass portion maximum height (1112) located approximately along the most upper portion of the mass portion vertical lip (750). The mass portion (510) decreases in thickness as it approaches the heel side external boundary (910), the toe side external boundary (915), and the forward external boundary (918). The mass portion maximum height (1112) comprises the maximum thickness of the mass portion (510). The maximum thickness of the mass portion (510) can range from 0.40 inch to 0.70 inch. For example, the maximum thickness of the mass portion (510) may be 0.40 inch, 0.50 inch, 0.60 inch, or 0.70 inch.

3) First Component Detachable and Embedded Weights

To allow further control of the mass properties of the assembled golf club head, a detachable weight recess and a detachable weight are provided, wherein the detachable weight mass can fine tune the mass properties of the golf club head at the point of assembly. The detachable weight recess (540) further comprises a plurality of detachable weight recess tabs. The plurality of detachable weight recess tabs may be two tabs, three tabs, four tabs, five tabs, or more than five tabs.

Figure 12:
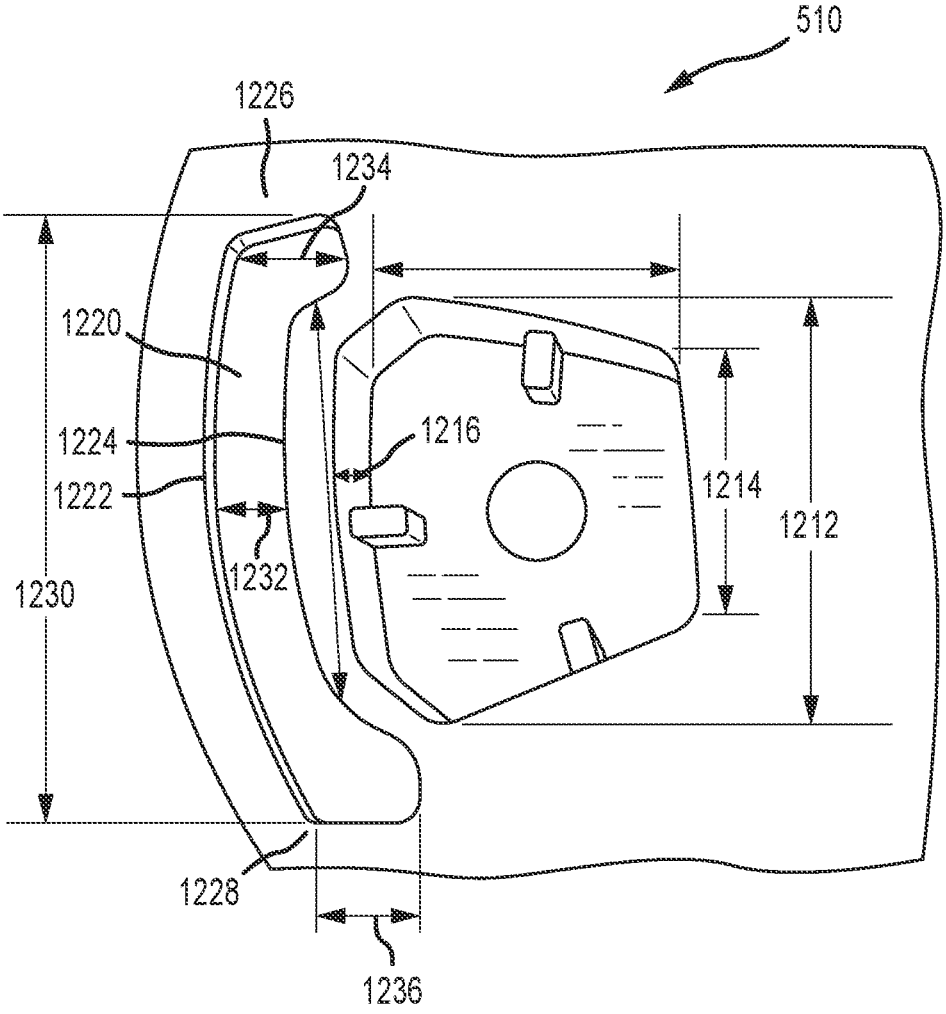
FIG. 12 illustrates a golf club head first component sole portion rear extension mass portion with a detachable weight recess and an embedded weight recess.

Referring to FIG. 12, it may be desirable to further increase the mass placed in the rear most portion of the golf club head. The mass portion (510) further comprises an embedded weight recess (1220). Therefore, an embedded weight recess (1220) and an embedded weight (1600) (configured to be received with the embedded weight recess (1220)) comprising an embedded weight material having a density that is higher than the first density of the first component (300) first material may be provided.

Figure 13:
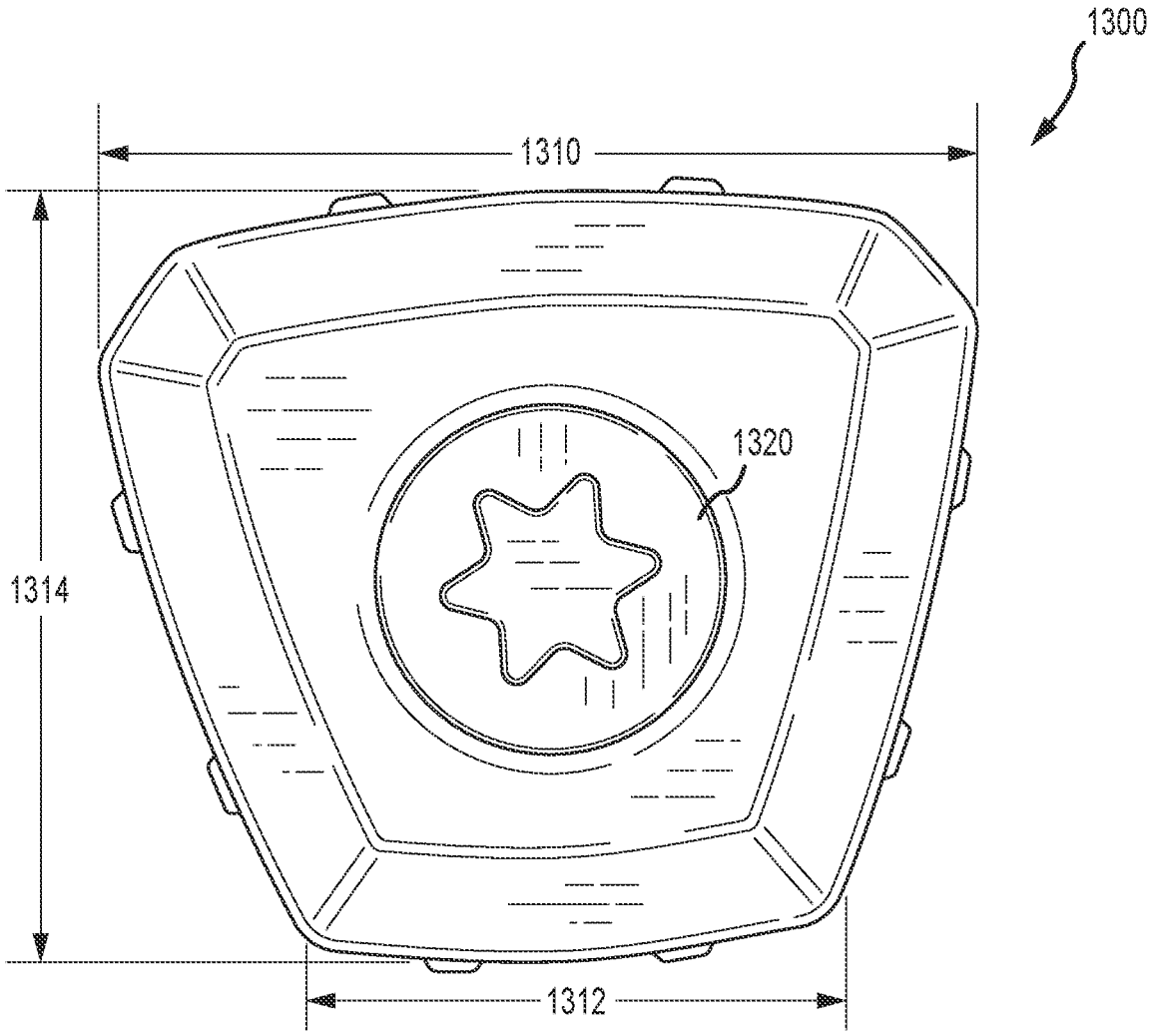
FIG. 13 illustrates a detachable weight with a threaded fastener—not shown in the Figures.

Referring to FIG. 13, the detachable weight (1300) can comprise a material such as steel, tungsten, aluminum, titanium, vanadium, chromium, cobalt, nickel, other metals, metal alloys, composite polymer materials or any combination thereof. In many embodiments, the sole weight can be tungsten. The detachable weight (1300) has a mass.

The detachable weight (1300) mass can range from 1.0 gram to 20.0 grams. For example, the detachable weight (1300) mass may be 1.0 gram, 1.5 grams, 2.0 grams, 3.0 grams, 4.0 grams, 5.0 grams, 6.0 grams, 7.0 grams, 8.0 grams, 9.0 grams, 10.0 grams, 11.0 grams, 12.0 grams, 13.0 grams, 14.0 grams, 15.0 grams, 16.0 grams, 17.0 grams, 18.0 grams, 19.0 grams, or 20.0 grams.

Referring to FIGS. 8 and 13, the detachable weight (1300) is configured to be received within the detachable weight recess (540). The detachable weight (1300) further comprises a through hole approximately in the center of the detachable weight (1300). The through hole is configured to receive a detachable weight threaded fastener (1320), allowing the threaded fastener (1320) to be threadably received in the threaded receiver boss (544) to secure the detachable weight (1300) into the detachable weight recess (540).

Figure 14:
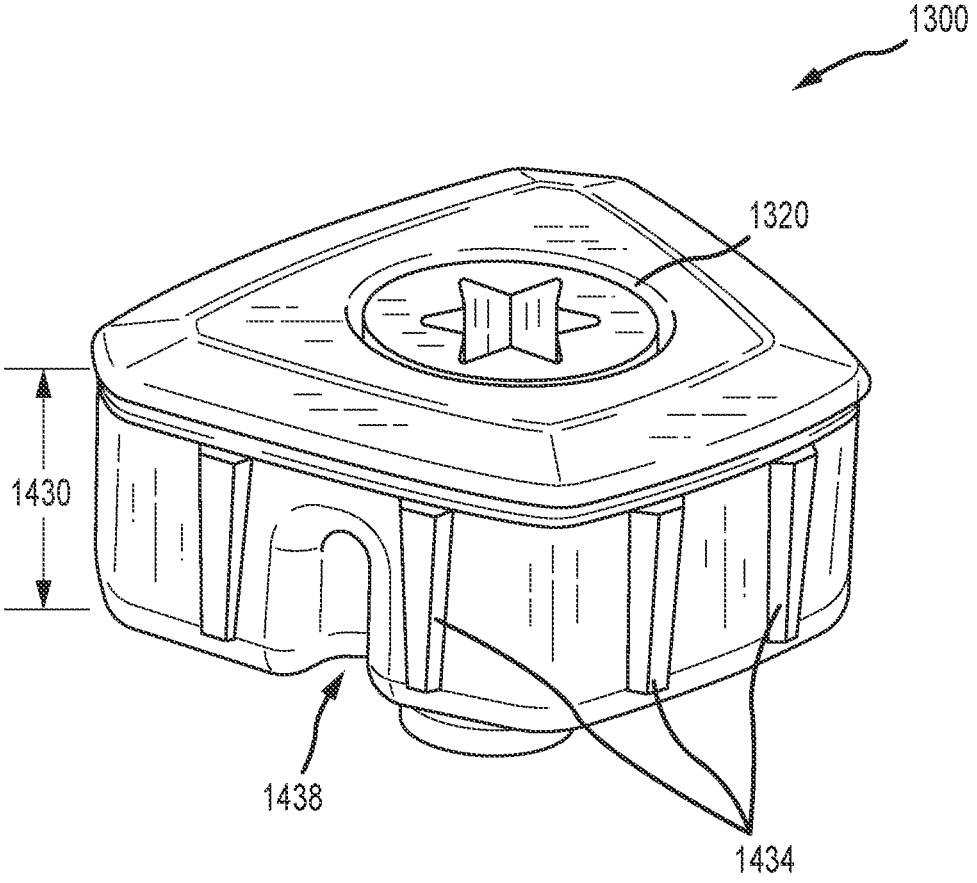
FIG. 14 illustrates side view of a detachable weight with a threaded fastener.

Referring to FIG. 14, the detachable weight (1300) further comprises a thickness (1430), a plurality of detachable weight offsets (1434), and a plurality of detachable weight side grooves (1438). The plurality of detachable weight offsets (1434) may be two offsets, three offsets, four offsets, five offsets, or more than five offsets. The plurality of detachable weight side grooves (1438) may be two grooves, three grooves, four grooves, five grooves, or more than five grooves. The offsets (1434) are configured to cause the detachable weight (1300) to be slightly offset from the walls of the detachable weight recess (540) when the detachable weight (1300) is received within the detachable weight recess (540). The detachable weight side grooves (1438) are configured to receive the detachable weight recess tabs when the detachable weight (1300) is received within the detachable weight recess (540).

Figure 16A:
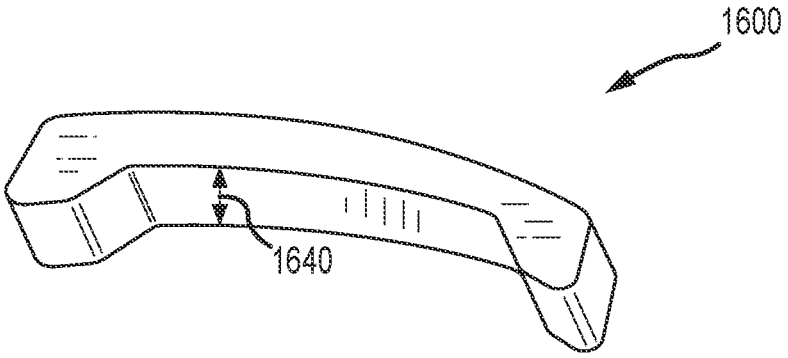
FIG. 16A illustrates a side view of an embedded weight for fitting in the embedded weight recess of FIG. 12.
Figure 16B:
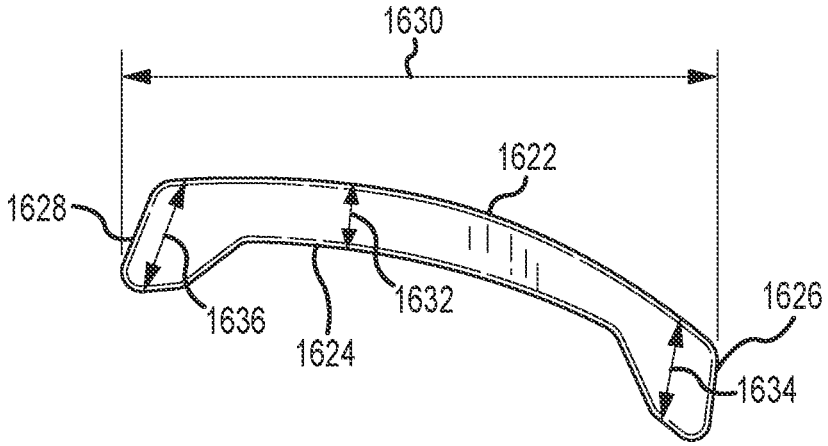
FIG. 16B illustrated a top view of an embedded weight.

Referring to FIGS. 16A and 16B, an embedded weight (1600) has a mass. The embedded weight (1600) mass can range from 1.0 gram to 20.0 grams. For example, the embedded weight (1600) mass may be 1.0 gram, 2.0 grams, 3.0 grams, 4.0 grams, 5.0 grams, 6.0 grams, 7.0 grams, 8.0 grams, 9.0 grams, 10.0 grams, 11.0 grams, 12.0 grams, 13.0 grams, 14.0 grams, 15.0 grams, 16.0 grams, 17.0 grams, 18.0 grams, 19.0 grams, or 20.0 grams.

The embedded weight (1600) comprises a tungsten material, a tungsten alloy material, a polymer matrix embedded with tungsten particles, or any other suitable material having a density greater than the first material density. The embedded weight (1600) is configured to fit within and be permanently affixed in the embedded weight recess (1220). The embedded weight (1600) may be permanently affixed using an adhesive, by swedging or other press fit methods, or by using an appropriate mechanical attachment means.

B) Second Component

The golf club head (100) comprises a first component (300) and a non-metallic, lightweight second component (200) configured to be coupled together to form the hollow golf club head (100). Referring to FIGS. 1F and 2, the second component (200) comprises a second component crown portion (205), a second component sole portion heel portion (214), a second component sole portion toe portion (212), a second component perimeter edge (220), a second component sole portion rear cutout (240) having a second component sole portion rear cutout width (242) and a second component sole portion rear cutout height (244), and a second component trailing edge portion (230). The second component (200) comprises matching grooves (not shown) on an interior surface of the second component (200), configured to align with and cover the first component tabs (457) when the first component (300) is coupled the second component (200) to form the golf club head (100).

As illustrated in FIGS. 1-4, the second component crown portion (205) wraps over the trailing edge (130), integrally forming the portions of the sole complementary to the first component. The second component heel and toe sole portions (214) (212) formed by the second component (200) can comprise a triangular shape positioned between the toe end extension and rear end extension, and rear end extension and heel end extension of the first component. In other embodiments, the sole portions formed by the second component (200) can comprise a circular shape, square shape, oval shape, any other polygonal shape, or a shape with at least one curved surface, complementary to the sole portions of the first component (100).

The second component (200) may comprise a single monolithic piece, entirely formed together with no further joining necessary. For example, the second component (200) can be formed by injection molding a single monolithic piece comprising a single material.

Alternately, the second component (200) may comprise a plurality of separately formed portions subsequently permanently joined by adhesives, sonic welding, fusion bonding, or other permanent joining methodologies appropriate to the materials used in forming the plurality of separately formed portions. For example, the second component crown portion (205), toe portion (212), and heel portion (214) may be formed separately from the same or different materials. The second component portions may then be adhesively joined to form the complete second component (200). Such forming of separate portions later joined may be advantageous when using materials such as bi-directional carbon fiber prepreg materials. Bi-directional carbon fiber prepreg does not easily accommodate certain small curvatures, and cannot be easily formed in a single piece to arrive at the desired second component (200) geometry. Using such a material may produce a need to form separate sole portions (212) and (214), which are later joined by adhesives or other methods to the rest of the second component (200).

The second component of the golf club head (100) can comprise a thickness. The thickness of the second component can range from 0.20 inch to 0.065 inch. In other embodiments, the thickness of the second component can range from 0.008 inch to 0.025 inch, 0.010 inch to 0.040 inch, 0.010 inch to 0.020 inch, 0.015 inch to 0.025 inch, 0.020 inch to 0.030 inch, 0.025 inch to 0.035 inch, 0.030 inch to 0.040 inch, 0.035 inch to 0.045 inch, 0.040 inch to 0.050 inch, 0.045 inch to 0.055 inch, 0.050 inch to 0.060 inch, or 0.055 inch to 0.065 inch. For example, the thickness of the second component can be 0.008 inch, 0.010 inch, 0.015 inch, 0.020 inch, 0.025 inch, 0.030 inch, 0.035 inch, 0.040 inch, 0.045 inch, 0.050 inch, 0.055 inch, 0.060 inch, or 0.065 inch. The thickness of the second component can further vary from the crown, the sole, the heel end, the toe end, and the trailing edge. The thickness of the second component internal ribs may be the same as the rest of the second component or may be up to 0.010 inch thicker than other portions of the second component (200).

Referring to FIG. 3, the second component (200) further comprises a plurality of second component reduced thickness sections (250) having one or more crown portion reduced thickness sections (255) and one or more sole portion reduced thickness sections (257). The second component (200) further comprises a plurality of second component internal ribs (260) having one or more crown portion internal ribs (262) and one or more sole portion internal ribs (264). The plurality of internal ribs (260) may be two ribs, three ribs, four ribs, five ribs, or more than five ribs. The crown portion (262) and sole portion (264) internal ribs are between the second component reduced thickness sections (250). The crown portion (262) and sole portion (264) internal ribs may comprise the greatest thickness of the second component (200). In some embodiments, the second component internal ribs (260) can be similar to the ribs as described in U.S. application Ser. No. 15/076,511, now U.S. Pat. No. 9,700,768. The second component internal ribs (260) can reduce stress on the golf club head (100) and improve sound during an impact.

The plurality of second component reduced thickness sections (250) comprise a thickness. The thickness of the plurality of second component reduced thickness sections (250) can range from 0.008 inch to 0.035 inch. In other embodiments, the thickness of the reduced thickness sections (250) can range from 0.008 inch to 0.015 inch, 0.010 inch to 0.020 inch, 0.015 inch to 0.025 inch, 0.020 inch to 0.030 inch, or 0.025 inch to 0.035 inch. For example, the thickness of the reduced thickness sections (250) can be 0.008 inch, 0.010 inch, 0.015 inch, 0.020 inch, 0.025 inch, 0.030 inch, or 0.035 inch.

The second component comprises a mass percentage of the overall mass of the golf club head (100). The mass percentage of the second component can range from 4% to 15% of the overall mass of the golf club head (100), or can be approximately 10 grams to 25 grams. In other embodiments, the mass percentage of the second component can range from 4% to 15%. For example, the mass percentage of the second component may be 4%, 5%, 6%, 7%. 8%, 9%, 10%, 11%, 12%, 13%, 14%, or 15% of the overall mass of the golf club head (100).

The second component comprises a outer surface area ranging from 17 $inch^2$ to 25 $inch^2$. In some embodiments, the surface area of the second component can range from 15 $inch^2$ to 27 $inch^2$, 15 $inch^2$ to 18 $inch^2$, 18 $inch^2$ to 21 $inch^2$, 21 $inch^2$ to 25 $inch^2$. For example, the surface area of the second component can be 15 $inch^2$, 17 $inch^2$, 19 $inch^2$, 21 $inch^2$, 23 $inch^2$, or 25 $inch^2$.

1) Second Component Materials

The second component (200) comprises a less dense material than the material of the first component. In some embodiments, the second component can comprise a composite. In other embodiments, the second component can comprise a composite integrated with fillers, (e.g. fibers, beads, etc.) In other embodiments still, the second component can comprise any high strength plastic integrated/co-molded with fibers (e.g. carbon fibers, glass fibers), beads (e.g. glass beads, metal beads), powders (e.g., tungsten powder), and/or any filler material for strength, durability, or weighting.

In many embodiments, the second component (200) of the golf club head (100) can be molded. In other embodiments, the second component (200) can be co-molded with the carbon fibers (or any additive filler materials described above, extruded, injection blow molded, mix of polymer/carbon fiber structured polymer, 3-D printed, or any other appropriate forming means.

In alternate embodiments, the second component (200) may comprise fiber reinforced composite (FRC) materials. FRC materials generally include one or more layers of a uni- or multi-directional fiber fabric that extend across a larger portion of the polymer. Unlike the reinforcing fibers that may be used in filled thermoplastic (FT) materials, the maximum dimension of fibers used in FRCs may be substantially larger/longer than those used in FT materials, and may have sufficient size and characteristics so they may be provided as a continuous fabric separate from the polymer. When formed with a thermoplastic polymer, even if the polymer is freely flowable when melted, the included continuous fibers are generally not.

FRC materials are generally formed by arranging the fiber into a desired arrangement, and then impregnating the fiber material with a sufficient amount of a polymeric material to provide rigidity. In this manner, while FT materials may have a resin content of greater than about 45% by volume or more preferably greater than about 55% by volume, FRC materials desirably have a resin content of less than about 45% by volume, or more preferably less than about 35% by volume. FRC materials traditionally use two-part thermoset epoxies as the polymeric matrix, however, it is possible to also use thermoplastic polymers as the matrix. In many instances, FRC materials are pre-prepared prior to final manufacturing, and such intermediate material is often referred to as a prepreg. When a thermoset polymer is used, the prepreg is partially cured in intermediate form, and final curing occurs once the prepreg is formed into the final shape. When a thermoplastic polymer is used, the prepreg may include a cooled thermoplastic matrix that can subsequently be heated and molded into final shape.

The second component (200) may be substantially formed from a formed fiber reinforced composite material that comprises a woven glass or carbon fiber reinforcing layer embedded in a polymeric matrix. In such an embodiment, the polymeric matrix is preferably a thermoplastic material such as, for example, polyphenylene sulfide (PPS), polyether ether ketone (PEEK), or a polyamide such as PA6 or PA66. In other embodiments, the second component (200) may instead be formed from a filled thermoplastic material that comprises a glass bead or discontinuous glass, carbon, or aramid polymer fiber filler embedded throughout the thermoplastic material such as, for example, polyphenylene sulfide (PPS), polyether ether ketone (PEEK), or polyamide. In still other embodiments, the second component (200) may have a mixed-material construction that includes both a filled thermoplastic material and a formed fiber reinforced composite material.

The second component (200) may have a mixed-material construction that includes both a fiber reinforced thermoplastic composite resilient layer (not shown) and a molded thermoplastic structural layer (not shown). In some preferred embodiments, the molded thermoplastic structural layer may be formed from a filled thermoplastic material that comprises a glass bead or discontinuous glass, carbon, or aramid polymer fiber filler embedded throughout a thermoplastic material such as, for example, polyphenylene sulfide (PPS), polyether ether ketone (PEEK), or a polyamide such as PA6 or PA66. The resilient layer may then comprise a woven glass, carbon fiber, or aramid polymer fiber reinforcing layer embedded in a thermoplastic polymeric matrix that includes, for example, a polyphenylene sulfide (PPS), a polyether ether ketone (PEEK), or a polyamide such as PA6 or PA66. In one particular embodiment, the second component (200) resilient layer may comprise a woven carbon fiber fabric embedded in a polyphenylene sulfide (PPS), and the second component (200) structural layer may comprise a filled polyphenylene sulfide (PPS) polymer.

In alternate embodiments, the second component (200) may have one or more interior cross connecting members (not shown). The cross connecting members may provide additional structural stiffness or sound control. The interior cross connecting members can comprise members that connect non-adjacent portions of the interior of the second component (200). For example, the cross connecting members may connect the interior surface of the second component crown portion (205) to one of the second component sole portion heel portion (214), or the second component sole portion toe portion (212). The interior cross connecting members may comprise a length that extends entirely from an interior surface of a front most edge of the second component (200) to the second component trailing edge portion (230) interior surface, or the interior cross connect members may comprise a length that does not extend entirely from an interior surface of a front most edge of the second component (200) to the second component trailing edge portion (230) interior surface. The interior cross connecting members comprise a thickness. The thickness of interior cross connecting members can range from 0.01 inch to 0.25 inch. For example, the thickness of interior cross connecting members may be 0.01 inch, 0.05 inch, 0.10 inch, 0.15 inch, 0.20 inch, or 0.25 inch. II) Coupling the First and Second Components A method of manufacturing the golf club head (100) comprises forming the first component (300), forming the second component (200), applying an adhesive to a first component lip (450), aligning the second component (200) to the first component (300), fitting the second component (200) to the first component (300) so the second component (200) overlays the lip (450), and allowing the adhesive to set, permanently affixing the second component (200) to the first component (300) to form the hollow golf club head (100).

Figure 15:
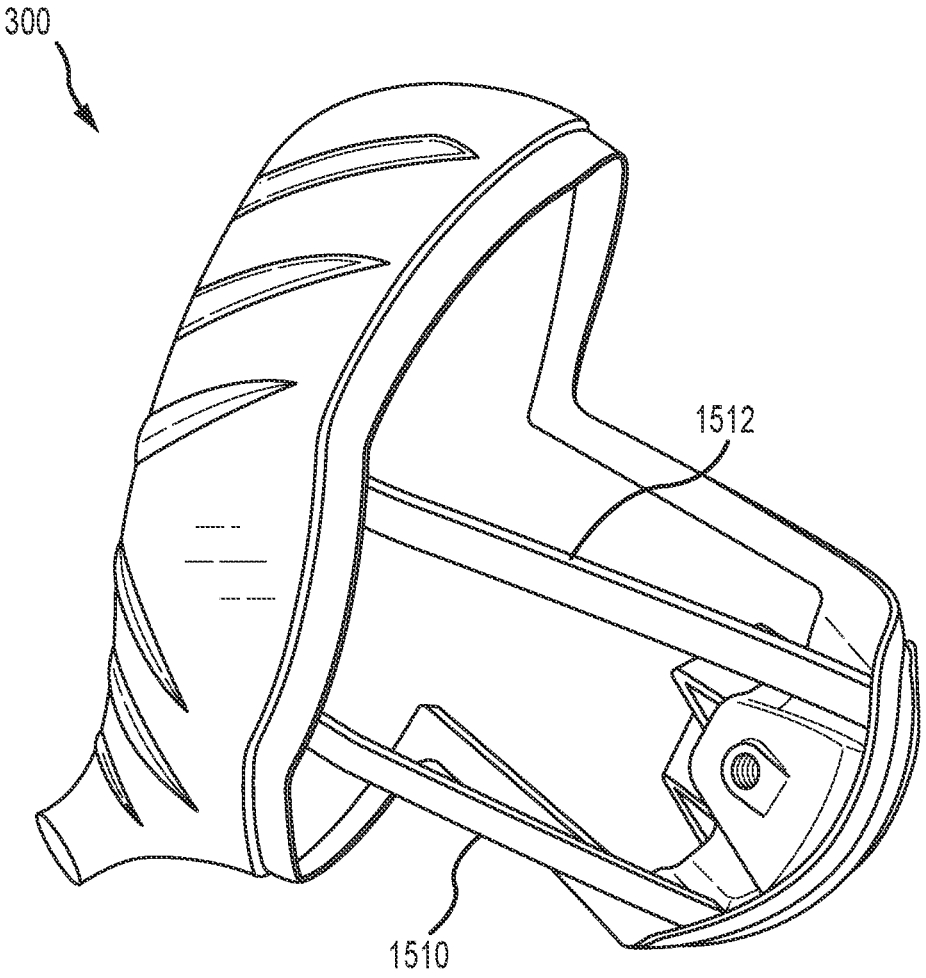
FIG. 15 illustrates a golf club head first component showing casting support bars.

Referring to FIG. 15, as discussed above, the first component (300) may further comprise a plurality of casting support bars, including one or more heel end casting support bars (1510), and one or more toe end casting support bars (1512). The casting support bars stabilize the cast part of the first component (300) while the metal cools after casting. The stabilization provided by the casting support bars prevents the front portion of the cast part from folding towards or away from the first component sole portion rear extension (500) while the part cools after casting. The casing support bars are removed from the as cast first component (300) and are not present in the finished golf club head (100).

An alternative method of manufacturing the golf club head (100) comprises casting the first component (300), molding a wax pattern of the first component (300), adding wax support bars to the wax pattern, investing the modified wax pattern, casting the investment, trimming the metal casting support bars (1510) and (1512), forming the first component (300), forming the second component (200), applying an adhesive to a first component lip (450), aligning the second component (200) to the first component (300), fitting the second component (200) to the first component (300) so the second component (200) overlays the lip (450), and allowing the adhesive to set, permanently affixing the second component (200) to the first component (300) to form the hollow golf club head (100). When adding the support bars to the wax pattern, the attachment points for the support bars are an interior surface of the first component (300) wax pattern, to avoid any marring or distortion of an outer surface of the first component (300) The advantage of adding the support bars is that the casting of the first component is supported against distortion while in a cooling phase after casting.

The first component (300) can be coupled to the second component (200) at the first component lip (450) to form the body of the golf club head (100). The first component lip (450), including the crown portion lip (455), the sole portion lip (460), and the mass portion vertical lip (750) are entirely covered by the second component (200) when the first component (300) is coupled to the second component (200) to form the body of the golf club head (100). The second component sole portion rear cutout (240) comprises a portion of perimeter edge (220) at the trailing edge portion (230). When the first component (300) is coupled to second component (200) at the first component lip (450) (to form the body of the golf club head (100)), the portion of perimeter edge (220) at the trailing edge portion (230) is joined along the mass portion trailing edge shelf (1042).

The first component (300) may be coupled to the second component (200) by means of an adhesive. In many embodiments, an adhesive such as glue, epoxy, epoxy gasket, tape (e.g., VHB tape), or any other adhesive materials can be disposed at the junction of the second component (200) and the first component lip (450). In other embodiments, the second component (200) can be coupled to the first component (300) by fasteners, clips, press fit, or any other appropriate mechanical means of attachment (not shown). In other embodiments, the first component (300) may be coupled to the second component (200) by an adhesive in conjunction with an appropriate mechanical means of attachment. In other embodiments, the first component (300) may be coupled to the second component (200) using laser welding to heat the second component (200) material to cause it to adhere to first component (300) material.

When the first component is coupled to the second component to form the golf club head 100), the surface of the first component (300) is not offset from the surface of the second component (200). When the first component (300) is coupled to the second component (200) to form the golf club head (100), a nominal outer surface of the first component is not offset above or below a nominal outer surface of the second component at the juncture of the coupling (i.e. the outer surfaces of the first component (300) and the second component (200) are flush).

III) T-Shaped Design Functions

As discussed above, the embodiment of a hollow golf club head (100) described herein can comprise two major components. The metallic, first component (300) comprises the striking portion and a sole extension (500) forming a "T" shape. The non-metallic, second component (200) comprises the rear portion of the crown (110), and wraps around the first component to also comprise a portion of the sole (120). The more dense "T" shaped sole of the first component (300), coupled to the less dense crown wrapped around second component (200) can optimize mass properties by reducing the crown mass, and shifting the golf club head center of gravity (CG) lower. The saved weight from the second component (200) can be redistributed to other locations of the golf club head (100) to further optimize the CG, increase the MOI, and manipulate the shape of the shot trajectory.

The CG of the golf club head (100) can move lower and toward the rear of the golf club head (100) comprising the first component (300) and the second component (200), wherein the second component (200) comprises a second material with a second density that is lower than the first material density, compared to an alternate golf club head comprising only the first material with a constant density.

Various features and advantages of the disclosures are set forth in the following clauses.

Clause 1. A golf club head comprising a body: the body comprising a striking face, a rear end, a toe end, a heel end, a crown, a sole, a trailing edge, a first component comprising the striking face and a striking face return, and a second component comprising at least a portion of the rear end, wherein: the first component comprises a first material having a first density; the second component comprises a second material having a second density; the first density is greater than the second density; the return portion of the first component extends rearwardly from the striking face and comprises a first component crown portion, and a first component sole portion; wherein a first component sole portion rear extension extends from the sole portion of the striking face return toward the rear end, wherein the sole portion of the striking face return and the first component sole portion rear extension form a T-shaped profile, wherein the second component is configured to be coupled to the first component to form an enclosed hollow interior of the golf club head.

Clause 2. The golf club head of clause 1, wherein the first material is a metallic material, and wherein the second material is selected from the group consisting of: a composite material integrated with carbon fibers, or a high strength plastic integrated and/or co-molded with carbon fibers, glass fibers, glass beads, or metallic powders.

Clause 3. The golf club head of clause 1, wherein the first component crown portion extends from the heel end toward the toe end in a negative parabolic profile relative to the strike face, and wherein the second component crown portion is complementary the first component crown portion.

Clause 4. The golf club head of clause 1, wherein the first component sole portion toe end extension extends 1.50 inches to 2.00 inches from the center near the strike face towards the toe end, wherein the first component sole portion heel end extension extends 0.90 inch to 1.40 inches from the center near the strike face towards the heel end.

Clause 5. The golf club head of clause 1, wherein the first component sole portion toe end extension comprises a width from 1.30 inches to 2.30 inches, and wherein the first component sole portion heel end extension comprises a width from 1.30 inches to 2.30 inches.

Clause 6. The golf club head of clause 1, wherein the first component sole portion rear extension comprises a length from 4.20 inches to 5.20 inches.

Clause 7. The golf club head of clause 1, wherein the first component sole portion rear extension comprises a width from 0.5 inch to 2.50 inches.

Clause 8. The golf club head of clause 1, wherein the first component sole portion rear extension extends toward the rear end perpendicular to the striking face.

Clause 9. The golf club head of clause 7, wherein the width of the first component sole portion rear extension varies as the first component sole portion rear extension extends toward the rear end, wherein the width of the first component sole portion rear extension is greater nearest the striking face and lessor furthest from the striking face.

Clause 10. The golf club head of clause 1, wherein the first component sole portion rear extension extends rearwards toward the toe end making an acute angle in relationship to an axis perpendicular to the strike face, wherein the acute angle is between 10 degrees and 40 degrees from the axis perpendicular to the strike face.

Clause 11. The golf club head of clause 1, wherein the first component sole portion rear end extension extends rearwards toward the heel end making an acute angle in relationship to an axis perpendicular to the strike face, wherein the acute angle is between 10 degrees and 40 degrees from the axis perpendicular to the strike face.

Clause 12. The golf club head of clause 1, wherein the first component of the body comprises a lip, wherein the lip is offset toward an interior of the golf club head such that a lip surface is recessed from a first component surface, wherein the lip entirely encompasses a rearward facing edge of the first component of the body, and wherein a depth of recession of the lip is between 0.01 inch and 0.50 inch.

Clause 13. The golf club head of clause 12, wherein the second component comprises a second component front edge, wherein the second component front edge is placed over the lip surface of the lip of the first component to form a lap joint when the first component is coupled to the second component to form the golf club head.

Clause 14. The golf club head of clause 1, wherein the first component sole portion rear extension comprises a weight port proximate the trailing edge, wherein the weight port is configured to receive a sole weight.

Clause 15. The golf club head of clause 4, wherein the width of first component sole portion toe end extension varies as the first component sole portion toe end extension extends from the center near the strike face towards the toe end, and wherein the width of the first component sole portion heel end extension varies as the first component sole portion heel end extension extends from the center near the strike face towards the heel end.

Clause 16. The golf club head of clause 14, wherein the first component comprises a first component mass when a sole weight is received in the weight port, wherein the first component mass is 93 percent to 97 percent of a total mass of the golf club head.

Clause 17. The golf club head of clause 14, wherein the second component comprises a second component mass, wherein the second component mass comprises 3 percent to 7 percent of a total mass of the golf club head.

Clause 18. The golf club head of clause 1, wherein when the golf club head is a driver type golf club head, the first component comprises a titanium material.

Clause 19. A golf club head comprising a body: the body comprising: a striking face, a striking face return, a rear end, a trailing edge, a toe end, a heel end, a crown, and a sole, wherein the body further comprises a first component and a second component, wherein the first component comprises a first material having a first density, wherein the second component comprises a second material having a second density, wherein the first density is greater than the second density, wherein the first component comprises the striking face and the striking face return, wherein the striking face returns comprises a first component crown portion, and a first component sole portion, wherein the second component comprises a second component crown portion, and at least two second component sole portions, wherein a first component sole portion rear end extension extends from the sole portion of the striking face return toward the rear end, wherein the striking face return sole portion and first component sole portion rear extension form a T-shaped profile, wherein the second component is configured to be coupled to the first component to form an enclosed hollow interior of the golf club head, wherein the first component of the body comprises a joint extension, wherein the joint extension is offset toward an interior of the golf club head such that a joint extension surface is recessed from a first component surface, wherein the joint extension entirely encompasses a rearward facing perimeter edge of the first component of the body, and wherein a depth of recession of the joint extension is between 0.01 inch and 0.50 inch, and wherein the second component comprises a front edge, wherein the front edge of the second component is placed over the joint extension surface of the joint extension of the first component to form a lap joint when the first component is coupled to the second component to form the golf club head.

Clause 20. The golf club head of clause 19, wherein an epoxy gasket is placed between the joint extension surface of the first component and the front edge of the second component when they form a lap joint to adhesively join the first component to the second component.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Custom within the industry, rules set by golf organizations such as the United States Golf Association (USGA) or The R&A, and naming convention may augment this description of terminology without departing from the scope of the present application.

While the above examples may be described in connection with a hollow body golf club, the apparatus, methods, and articles of manufacture described herein may be applicable to other types of golf club such as an iron-type golf club, a wedge-type golf club, or a putter-type golf club. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Example

A comparative club head and an exemplary club head of the instant application are compared in Table 1. The comparative club is entirely metallic, but has similar total mass and total volume as the exemplary club head. The exemplary club head is an embodiment of the golf club head of the instant application.

TABLE 1

| | $CG_y$ | $CG_z$ | $I_{XX}$ | $I_{YY}$ | Mass | Volume |
|---|---|---|---|---|---|---|
| Comparative Golf Club Head | 0.895 | 1.913 | 584.45 | 834.3 | 205.7 g | $445_{CC}$ |
| Exemplary Golf Club Head | 0.887 | 1.986 | 652.71 | 875.94 | 205.8 g | $445_{CC}$ |
| Exemplary Golf Club Head with Embedded Weight | 0.89 | 2.013 | 678.31 | 901.78 | 205.2 g | $445_{CC}$ |

The comparative club head and an exemplary club head have equal volumes of approximately 445 cm3. The comparison club, constructed entirely of a metallic material has a $CG_y$, which is the height of the CG above the ground plane (105), of 0.895 inch. The exemplary golf club head has a $CG_y$ of 0.887 inch. It is desirable to have a lower value for $CG_y$. The $CG_y$ of the exemplary golf club head is lower than that of the comparison club by 0.008 inch.

As described above, $CG_2$ is measured as a distance the CG is located toward the rear end of the golf club head from the strike face center (175) in a direction perpendicular to the loft plane of the (198). A greater $CG_2$, located further to the rear of the golf club, is beneficial for ball flight control. The comparison club, has a $CG_2$ of 1.913 inches. The exemplary golf club head has a $CG_2$ of 1.986 inches. The $CG_2$ of the exemplary golf club head is 0.073 inch further back than the $CG_2$ of the comparison club.

The position of the CG helps determine the launch characteristics of a ball (e.g., ball trajectory, ball spin, and ball speed), moment of inertia (MOI), and performance characteristics (e.g., swing speed, squaring the face during impact). A high MOI prevents rotation of the golf club head during a swing, and helps square the striking face during impact with the ball. Striking the ball with a squared striking face helps ensure a straight ball path and optimal height/trajectory, compared to slicing or hooking the ball when the striking face is not squared. Further, with a lower CG, the speed and spin of the ball are improved, which can add distance and prevent the ball rolling backwards upon landing.

The MOI of the exemplary golf club head (is greater than the MOI of the comparison golf club. MOI values $I_{XX}$ and $I_{YY}$ are the MOI values about the X axis (190) and Y axis, (192) respectively. Larger MOI is desirable, as a high MOI helps prevent rotation of the golf club head during a swing, and helps square the striking face during impact with the ball. The comparative club has $I_{XX}$ and $I_{YY}$ values of 584.45 and 834.30, respectively. The exemplary golf club head has $I_{XX}$ and In values of 652.71 and 875.94, respectively. The exemplary golf club head has a quite large 11.7% improvement of $I_{XX}$, and a 5.0% improvement of $I_{YY}$ over the comparative club.

The ball flight of a golf ball struck by the exemplary golf club head has improved $CG_y$, and $CG_2$ values, directly leading to improved $I_{XX}$ and $I_{YY}$ values. The improved CG values leads to lower ball spin at impact, which leads to a longer carry for the ball flight. The improved MOI values lead directly to more forgiveness for off center hits.

In an alternate embodiment, an embedded high density weight was added to the exemplary golf club head. The exemplary golf club head with weight has a $CG_y$ of 0.890 inch and a $CG_2$ of 2.013 inches. The exemplary golf club head with weight $CG_y$ is less than the $CG_y$ of the comparative golf club head by 0.005 inch, but the $CG_2$ of the exemplary golf with weight is greater than the $CG_2$ of the comparative golf club head by 0.100 inch. The exemplary golf club head with weight has an $I_{XX}$ value of 678.31, and In value of 901.78. These MOI values are both greater than the $I_{XX}$ and $I_{YY}$ of the comparative golf club head by 16% and 8.1%, respectively.

What is claimed is:

1. A golf club head comprising a body:

the body comprising a striking face, a rear end, a toe end, a heel end, a crown, a sole, a trailing edge, wherein an X-axis extends through a striking face center in a direction from the heel end to the toe end of the golf club head, and parallel to a ground plane when the club head is at an address position, a Y-axis extends through the striking face center in a direction from the crown to the sole of the golf club head, and perpendicular to the X-axis, a Z-axis extends through the striking face center in a direction from the striking face to the golf club head rear end and perpendicular to the X-axis and the Y-axis, and a YZ plane extends through the Y-axis and the Z-axis, a first component comprising the striking face and a striking face return, and a second component comprising at least a portion of the rear end, wherein:

the first component comprises a first material having a first density;

the second component comprises a second material having a second density;

the first density is greater than the second density;

the striking face return of the first component extends rearwardly from the striking face and comprises a first component crown portion, and a first component sole portion;

wherein a first component sole portion rear extension extends from the first component sole portion of the striking face return toward the rear end, wherein the first component sole portion of the striking face return and the first component sole portion rear extension form a T-shaped profile, wherein the second component is configured to be coupled to the first component to form an enclosed hollow interior of the golf club head;

wherein the first component sole portion rear extension extends rearwards making an acute angle in relationship to an axis perpendicular to the strike face, wherein the first component sole portion rear extension comprises a mass portion, wherein the mass portion comprises a weight recess proximate to the trailing edge, wherein the weight recess is configured to receive a detachable sole weight, and wherein the mass portion comprises between 20% and 35% of a total mass of the golf club head;

wherein the mass portion comprises:

a mass portion maximum height, a mass portion interior length, a vertical lip having a vertical lip height and a vertical lip length, a mass portion trailing edge shelf having a shelf length, a shelf height, and a shelf width, an interior forward boundary, the mass portion further comprises a heel side external boundary, a toe side external boundary, and a forward external boundary;

wherein the vertical lip is offset toward an interior of the golf club head such that a vertical lip surface is recessed from a first component outer surface, wherein the vertical lip entirely encompasses a rearward facing edge of the first component of the body, and wherein a depth of recession of the vertical lip is between 0.01 inch and 0.50 inch.

2. The golf club head of claim 1 wherein the mass portion is bisected by the YZ plane.

3. The golf club head of claim 1, wherein the mass portion further comprises an interior forward edge; and;

wherein the weight recess further comprises a weight recess interior forward edge.

4. The golf club head of claim 3, wherein one or more mass portion interior ribs are attached to the mass portion weight recess interior forward edge.

5. The golf club head of claim 4, wherein the one or more mass portion interior ribs comprise one rib, two ribs, three ribs, four ribs, five ribs, or more than five ribs.

6. The golf club head of claim 4, wherein the mass portion interior ribs further comprise an interior rib height, and interior rib width, and an interior rib length, wherein the interior rib width varies in a range from 0.025 inch to 0.100 inch, wherein the interior rib length varies in a range from 0.100 inch to 1.500 inches.

7. The golf club head of claim 6, wherein the mass portion weight port recess further comprises a weight recess depth, wherein the interior rib height varies from 25% to 100% of weight recess depth.

8. The golf club head of claim 1, wherein the mass portion maximum height comprises a mass portion maximum thickness, wherein the mass portion maximum thickness varies from 0.40 inch to 0.70 inch.

9. The golf club head of claim 8, wherein the mass portion decreases in thickness as it approaches the heel side external boundary, wherein the mass portion decreases in thickness as it approaches the toe side external boundary, wherein the mass portion decreases in thickness as it approaches the forward external boundary.

10. The golf club head of claim 1, wherein the second component comprises a second component front edge, wherein the second component front edge is placed over the vertical lip surface of the first component to form a lap joint when the first component is coupled to the second component to form the golf club head.

11. The golf club head of claim 1, wherein a first component sole portion toe end extension extends 1.50 inches to 2.00 inches from the YZ plane towards the toe end, wherein a first component sole portion heel end extension extends 0.90 inch to 1.40 inches from the YZ plane towards the heel end.

12. The golf club head of claim 11, wherein a width of the first component sole portion toe end extension varies as the first component sole portion toe end extension extends from the YZ plane towards the toe end, and wherein a width of the first component sole portion heel end extension varies as the first component sole portion heel end extension extends from the YZ plane towards the heel end.

13. The golf club head of claim 11, wherein the first component sole portion rear extension is offset relative to the YZ plane in a direction that is parallel to the X-axis toward the toe end.

14. The golf club head of claim 1, wherein when the golf club head is a driver type golf club head, the first component comprises a titanium material.

15. The golf club head of claim 1, wherein the first component sole portion rear extension is offset relative to the YZ plane in a direction that is parallel to the X-axis toward the heel end.

16. The golf club head of claim 1, wherein the acute angle is between 10 degrees and 40 degrees from the axis perpendicular to the strike face.

* * * * *